US009920989B2

(12) United States Patent
Luy et al.

(10) Patent No.: US 9,920,989 B2
(45) Date of Patent: Mar. 20, 2018

(54) PROCESS LINE FOR THE PRODUCTION OF FREEZE-DRIED PARTICLES

(71) Applicant: Sanofi Pasteur SA, Lyons (FR)

(72) Inventors: Bernhard Luy, Freiburg (DE); Matthias Plitzko, Neuenburg (DE); Manfred Struschka, Auggen (DE)

(73) Assignee: Sanofi Pasteur SA, Lyons (FR)

( * ) Notice: Subject to any disclaimer, the term of this patent is extended or adjusted under 35 U.S.C. 154(b) by 0 days.

(21) Appl. No.: 14/348,877

(22) PCT Filed: Oct. 4, 2012

(86) PCT No.: PCT/EP2012/004162

§ 371 (c)(1),
(2) Date: Mar. 31, 2014

(87) PCT Pub. No.: WO2013/050156

PCT Pub. Date: Apr. 11, 2013

(65) Prior Publication Data

US 2014/0245629 A1 Sep. 4, 2014

(30) Foreign Application Priority Data

Oct. 5, 2011 (EP) ..... 11008057

(51) Int. Cl.
*F26B 5/06* (2006.01)

(52) U.S. Cl.
CPC ..... *F26B 5/06* (2013.01); *F26B 5/065* (2013.01)

(58) Field of Classification Search
CPC .... F26B 5/06; F26B 5/065; F26B 5/12; F26B 7/00; F26B 17/128

(Continued)

(56) References Cited

U.S. PATENT DOCUMENTS 2,388,917 A 11/1945 Hormel
3,303,578 A 2/1967 Rockwell et al.

(Continued)

FOREIGN PATENT DOCUMENTS

CA 2051092 C 3/1992
CN 1607942 A 4/2005

(Continued)

OTHER PUBLICATIONS

International Search Report and Written Opinion received in connection with international application No. PCT/EP2012/004162; dated Nov. 28, 2012.

(Continued)

*Primary Examiner* — Jessica Yuen

(57) ABSTRACT

A process line (300) for the production of freeze-dried particles under closed conditions comprising at least a spray chamber (302) for droplet generation and freeze congealing of the liquid droplets to form particles and a bulk freeze-dryer (304) for freeze drying the particles, the freeze-dryer (304) comprising a rotary drum for receiving the particles. Further, a transfer section (308) is provided for a product transfer from the spray chamber (302) to the freeze-dryer (304). For the production of the particles under end-to-end closed conditions each of the devices (302, 304) and of the transfer section (308) is separately adapted for operation preserving sterility of the product to be freeze-dried and/or containment.

27 Claims, 10 Drawing Sheets

(58) Field of Classification Search
USPC ... 34/284, 287, 288, 302, 304, 92, 108, 603, 34/139
See application file for complete search history.

(56) References Cited

U.S. PATENT DOCUMENTS

| | | | | |
|---|---|---|---|---|
| 3,601,901 | A | 8/1971 | Rader | |
| 3,621,587 | A | 11/1971 | Smith, Jr. | |
| 4,033,048 | A | 7/1977 | Van Ike | |
| 5,230,162 | A | 7/1993 | Oyler, Jr. | |
| 6,745,490 | B2 | 6/2004 | Akimoto et al. | |
| 7,344,720 | B2 | 3/2008 | Haensler | |
| 2002/0050072 | A1 | 5/2002 | Akimoto et al. | |
| 2006/0165717 | A1 | 7/2006 | Dalencon et al. | |
| 2007/0218138 | A1 | 9/2007 | Bittorf et al. | |
| 2008/0000362 | A1* | 1/2008 | Ringstrom | A23C 3/04 99/485 |
| 2008/0060213 | A1 | 3/2008 | Gehrmann et al. | |
| 2014/0230266 | A1 | 8/2014 | Luy et al. | |
| 2014/0237846 | A1 | 8/2014 | Plitzko et al. | |
| 2014/0373383 | A1 | 12/2014 | Struschka et al. | |
| 2015/0007445 | A1 | 1/2015 | Gebhard et al. | |

FOREIGN PATENT DOCUMENTS

| | | | | |
|---|---|---|---|---|
| CN | 101959527 | A | | 1/2011 |
| DE | 31 05 623 | A1 | | 9/1982 |
| DE | 41 13 512 | A1 | | 10/1992 |
| DE | 196 54 134 | C2 | | 11/1997 |
| DE | 102004005660 | A1 | | 8/2005 |
| DE | 202006018276 | U1 | | 2/2007 |
| DE | 102007055488 | A1 | | 6/2008 |
| EP | 0 699 645 | A1 | | 3/1996 |
| EP | 0 730 907 | A2 | | 9/1996 |
| EP | 2 101 131 | A1 | | 9/2009 |
| FR | 1378749 | | * | 11/1964 |
| JP | 2009-530415 | A | | 8/1927 |
| JP | S 55-112980 | U | | 9/1980 |
| JP | 08-104588 | A | | 4/1996 |
| JP | 09-071536 | | | 3/1997 |
| JP | 2002-130941 | A | | 5/2002 |
| JP | 2004-232883 | A | | 8/2004 |
| JP | 2004232883 | A | * | 8/2004 |
| JP | 2008-507307 | A | | 3/2008 |
| WO | WO 2005/105253 | | | 11/2005 |
| WO | WO 2006/008006 | A1 | | 1/2006 |
| WO | WO 2007/006939 | | | 1/2007 |
| WO | WO 2008/009309 | | | 1/2008 |
| WO | WO 2009/109550 | A1 | | 9/2009 |
| WO | WO 2013/050157 | | | 4/2013 |
| WO | WO 2013/050158 | | | 4/2013 |
| WO | WO 2013/050161 | | | 4/2013 |
| WO | WO 2013/050162 | | | 4/2013 |

OTHER PUBLICATIONS

Letter and Article 34 Amendments submitted in connection with international application No. PCT/EP2012/004162; dated Jul. 31, 2013.
Written Opinion of the International Preliminary Examining Authority received in connection with international application No. PCT/EP2012/004162; dated Sep. 25, 2013.
Response submitted in connection with international application No. PCT/EP2012/004162; dated Dec. 10, 2013.
International Preliminary Report on Patentability received in connection with international application No. PCT/EP2012/004162; dated Jan. 9, 2014.
European Search Report and the European Search Opinion Dated Mar. 9, 2012 From the European Patent Office Re. Application No. 11008057.9.
International Preliminary Report on Patentability Dated Jan. 29, 2014 From the International Preliminary Examining Authority Re. Application No. PCT/EP2012/004168.
International Search Report and the Written Opinion Dated Nov. 28, 2012 From the International Searching Authority Re. Application No. PCT/EP2012/004168.
Official Action Dated Mar. 25, 2016 From the U.S. Patent and Trademark Office Re. U.S. Appl. No. 14/348,869.
Notice of Panel Decision from Pre-Appeal Brief Review dated Dec. 29, 2016 From the U.S. Patent and Trademark Office Re. U.S. Appl. No. 14/348,869. (2 pages).
Official Action Dated Aug. 25, 2016 From the U.S. Patent and Trademark Office Re. U.S. Appl. No. 14/348,869. (16 pages).
Official Action Dated Jun. 19, 2017 From the U.S. Patent and Trademark Office Re. U.S. Appl. No. 14/348,869. (12 pages).
Official Action Dated Dec. 3, 2014 From the U.S. Patent and Trademark Office Re. U.S. Appl. No. 14/348,869.
Official Action Dated Mar. 27, 2015 From the U.S. Patent and Trademark Office Re. U.S. Appl. No. 14/348,869.

* cited by examiner

PROCESS LINE FOR THE PRODUCTION OF FREEZE-DRIED PARTICLES

TECHNICAL FIELD

The invention relates to freeze-drying and in particular to the production of freeze-dried pellets as bulkware, wherein a process line for the production of freeze-dried pellets comprises at least a spray chamber for droplet generation and freeze congealing of the liquid droplets to form pellets, and a freeze-dryer for freeze-drying the pellets.

BACKGROUND OF THE INVENTION

Freeze-drying, also known as lyophilization, is a process for drying high-quality products such as, for example, pharmaceuticals, biological materials such as proteins, enzymes, microorganisms, and in general any thermo- and/or hydrolysis-sensitive material. Freeze-drying provides for the drying of the target product via the sublimation of ice crystals into water vapor, i.e., via the direct transition of water content from the solid phase into the gas phase. Freeze-drying is often performed under vacuum conditions, but works generally also under atmospheric pressure.

In the fields of pharmaceuticals and biopharmaceuticals freeze-drying processes may be used, for example, for the drying of drug formulations, Active Pharmaceutical Ingredients ("APIs"), hormones, peptide-based hormones, monoclonal antibodies, blood plasma products or derivatives thereof, immunological compositions including vaccines, therapeutics, other injectables, and in general substances which otherwise would not be stable over a desired time span. In freeze-dried products the water and/or other volatile substances are removed prior to sealing the product in vials or other containers. In the fields pharmaceuticals and biopharmaceuticals the target products are typically packaged in a manner to preserve sterility and/or containment. The dried product may later be reconstituted by dissolving it in an appropriate reconstituting medium (e.g., sterile water or other pharmaceutical grade diluents) prior to use or administration.

Design principles for freeze-dryer devices are known. For example, tray-based freeze-dryers comprise one or more trays or shelves within a (vacuum) drying chamber. Vials can be filled with the product and arranged on a tray. The tray with the filled vials is introduced into the freeze-dryer and the drying process is started.

Process systems combining spray-freezing and freeze-drying are also known. For instance, U.S. Pat. No. 3,601,901 describes a highly integrated device comprising a vacuum chamber with a freezing compartment and a drying compartment. The freezing compartment comprises a spray nozzle on top of an upwardly projecting portion of the vacuum chamber. The sprayed liquid is atomized and rapidly frozen into a number of small frozen particles which fall down within the freezing compartment to arrive at a conveyor assembly. The conveyor advances the particles progressively for freeze-drying in the drying compartment. When the particles reach the discharge end of the conveyer, they are in freeze-dried form and fall downwardly into a discharge hopper.

In another example, WO 2005/105253 describes a freeze-drying apparatus for fruit juices, pharmaceuticals, nutraceuticals, teas, and coffees. A liquid substance is atomized through a high-pressure nozzle into a freezing chamber wherein the substance is cooled to below its eutectic temperature, thereby inducing a phase change of liquids in the substance. A co-current flow of cold air freezes the droplets. The frozen droplets are then pneumatically conveyed by the cold air stream via a vacuum lock into a vacuum drying chamber and are further subjected to an energy source therein to assist sublimation of liquids as the substance is conveyed through the chamber.

Many products are compositions comprising two or more different agents or components that are mixed prior to freeze-drying. The composition is mixed with a predefined ratio and is then freeze-dried and filled into vials for shipping. A change in the mixing ratio of the composition after filling into the vials is practically not feasible. In typical freeze-drying procedures the mixing, filling and drying processes therefore cannot normally be separated.

WO 2009/109550 A1 discloses a process for stabilizing a vaccine composition containing an adjuvant. It is proposed to separate, if desirable, the drying of the antigen from the drying of the adjuvant, followed by blending of the two components before combined filling or to employ sequential filling of the respective components. Specifically, separate micropellets comprising either the antigen or the adjuvant are generated. The antigen micropellets and the adjuvant micropellets are then blended before filling into vials, or are directly filled to achieve the desired mixing ratio specifically at the time of blending or filling. The methods are said to further provide be an improvement in the composition's overall stability, as the formulations can be optimized independently for each component. The separated solid states are said to avoid interactions between the different components throughout storage, even at higher temperature.

Products in the pharmaceutical and biopharmaceutical fields often have to be manufactured under closed conditions, i.e., they have to be manufactured under sterile conditions and/or under containment. A process line adapted for a production under sterile conditions has to be designed such that no contaminates can enter into the product. Similarly, a process line adapted for production under containment conditions has to be adapted such that neither the product, elements thereof, nor auxiliary materials can leave the process line and enter the environment.

Two approaches are known for the engineering of process lines adapted for production under closed conditions. The first approach comprises placing the entire process line or parts/devices thereof into at least one isolator, the latter being a device isolating its interi- or and the environment from each other and maintaining defined conditions inside. The second approach comprises developing an integrated process system providing for sterility and/or containment, which is usually achieved by integrating within one housing a device which is specifically adapted and highly integrated to perform all the desired process functions.

As an example for the first approach, WO 2006/008006 A1 describes a process for the sterile freezing, freeze-drying, storing, and assaying of a pelletized product. The process comprises freezing droplets of the product to form pellets, freeze-drying the pellets, then assaying and loading the product into containers. More particularly, the frozen pellets are created in a freezing tunnel and then they are directed into a drying chamber, wherein the pellets are freeze-dried on a plurality of pellet-carrying surfaces. After freeze-drying, the pellets are unloaded into storage containers. The process of pelletizing and freeze-drying is performed in a sterile area implemented inside an isolator. Filled storage containers are transferred into a storage assay. For final filling, storage containers are transferred into another sterile isolator area containing a filling line, where the containers' contents are transferred to vials, these being sealed after filling and finally unloaded from the isolated filling line.

Putting a process line into a box, i.e., into one or more isolators, appears to be a straightforward approach for ensuring sterile production. However, such systems and the operation thereof become increasingly complex and costly with increasing size of the processes and correspondingly increasing size of the required isolator(s). Cleaning and sterilization of these systems requires not only the process line to be cleaned and sterilized after each production run, but also the isolator. In cases where two or more isolators are required, interfaces between the isolated areas occur that require additional efforts for protecting the steprility of the product. At some point, process devices and/or isolators can no longer be realized from standard devices and have to be specifically developed further increasing complexity and costs.

An example of the second approach to providing process lines for production under closed conditions, namely providing a specifically adapted and highly integrated system, is given by the above-mentioned U.S. Pat. No. 3,601,901. According to the '901 patent a freezing compartment and a drying compartment are formed within a single vacuum chamber. Such an approach generally excludes the use of standard devices, i.e., the process equipment is per se costly. Further, due to the highly integrated implementation of the various process functions normally the entire system is in one particular mode, for example in a production run, or in a maintenance mode such as cleaning or sterilization which limits the flexibility of the process line.

SUMMARY OF THE INVENTION

In view of the above, one object underlying the present invention is to provide a process line and corresponding processes for the production of freeze-dried particles including particles produced under closed conditions. Another object of the invention is to provide more cost-effective process lines than are presently available. A further object of the present invention is to provide a process line that is flexibly adaptable such that, for example, production times are shorter, the general operation of the process line is more efficient, and/or the system can be more flexibly configured for sequential and/or concurrent production, maintenance, cleaning, and sterilization etc. operations.

According to one embodiment of the invention, one or more of the above objects are achieved by a process line for the production of freeze-dried particles under closed conditions, wherein the process line comprises at least the following separate devices: 1) a spray chamber for droplet generation and freeze congealing of the liquid droplets to form particles; and 2) a bulk freeze-dryer for freeze-drying the particles. A transfer section is provided for a product transfer from the spray chamber to the freeze-dryer. For the production of the particles under end-to-end closed conditions, each of the devices and transfer sections are separately adapted for operation preserving sterility of the product to be freeze-dried and/or containment.

The particles can comprise, for example, pellets and/or granules. The term "pellet(s)" as used herein may be understood as preferably referring to particles with a tendency to be generally spherical/round. However, the invention is likewise applicable to other particles or microparticles (i.e., particles in the micrometer range), such as for example irregularly formed granules or microgranules (wherein the latter have at least their main dimensions in the micrometer range). Pellets with sizes in the micrometer range are called micropellets. According to one example, the process line can be arranged for the production of essentially or predominantly round freeze-dried micropellets with a mean value for the diameters thereof chosen from a range of about 200 to about 800 micrometers (μm), with a selectable, preferably narrow particle size distribution of about ±50 μm around the chosen value.

The term "bulkware" can be broadly understood as referring to a system or plurality of particles which contact each other, i.e., the system comprises multiple particles, microparticles, pellets, and/or micropellets. For example, the term "bulkware" may refer to a loose amount of pellets constituting at least a part of a product flow, such as a batch of a product to be processed in a process device or a process line, wherein the bulkware is loose in the sense that it is not filled in vials, containers, or other recipients for carrying or conveying the particles/pellets within the process device or process line. Similar holds for use of the substantive or adjective "bulk."

The bulkware as referred to herein will normally refer to a quantity of particles (pellets, etc.) exceeding a (secondary, or final) packaging or dose intended for a single patient. Instead, the quantity of bulkware may relate to a primary packaging; for example, a production run may comprise production of bulkware sufficient to fill one or more intermediate bulk containers (IBCs).

Flowable materials suitable for spraying and/or prilling using the devices and methods of the present invention include liquids and/or pastes which, for example, have a viscosity of less than about 300 mP*s (millipascal*second). As used herein, the term "flowable materials" is interchangeable with the term "liquids" for the purpose of describing materials entering the various process lines contemplated for spraying/prilling and/or freeze-drying.

Any material may be suitable for use with the techniques according to the invention in case the material is flowable, and can be atomized and/or prilled. Further, the material must be congealable and/or freezable.

The terms "sterility" ("sterile conditions") and "containment" ("contained conditions") are understood as required by the applicable regulatory requirement for a specific case. For example, "sterility" and/or "containment" may be understood as defined according to GMP ("Good Manufacturing Practice") requirements.

A "device" is understood herein as a unit of equipment or a component which performs a particular process step, for example a spray chamber or spray-freezer performs the process step of droplet generation and freeze congealing of the liquid droplets to form particles, a freeze-dryer performs the process step of freeze-drying frozen particles, etc.

It is further understood herein that a process line for a production of particles under end-to-end closed conditions necessarily has to include means for feeding liquid under sterile conditions and/or containment conditions to the process line, and further has to include one or more means for discharging the freeze-dried particles under sterile conditions and/or containment conditions.

In one embodiment, one or more transfer sections permanently interconnect two, or more, devices to form an integrated process line for the production of the particles under end-to-end closed conditions. Generally, the various devices of a process line for a production of freeze-dried particles under closed conditions can be provided as separate devices which are (e.g., permanently connected) connected to each other by one or more transfer sections. Individual transfer sections may provide permanent connections between two or more devices, for example, by mechanically, rigidly and/or fixedly connecting or joining the respective devices to each other. A transfer section can be single- or double-walled, wherein in the latter case an outer wall may provide for permanent interconnection of process devices and may for example delineate defined process conditions in a process volume confined by the outer wall, while an inner wall may or may not permanently interconnect the process devices. For example, the inner wall can form a tube within the process volume which is connected between the devices only in case of a product transfer.

In preferred embodiments, each of the process devices such as the spray chamber and the freeze-dryer are separately adapted for closed operation. For example, the spray chamber can be individually adapted for sterile operation and, independently thereof, the freeze-dryer can be individually adapted for sterile operation. Similarly, any further device(s) included in the process line can also be individually adapted or optimized for an operation under closed conditions. As for the devices, each of the one or more transfer sections can also be individually adapted for an operation under closed conditions, which implies that each transfer section can be adapted for keeping or protecting sterility, and/or containment along the product transfer through the transfer section, and at the transitions from a device into the transfer section and from the transfer section to another device.

Transfer sections may comprise means for operatively separating the two connected devices from each other such that at least one of the two devices is operable under closed conditions separately from the other device without affecting the integrity of the process line.

The means for operatively separating the two connected devices may comprise a valve, for example a vacuum-tight valve, a vacuum lock, and/or a component which enables sealably separating the components from each other. For example, operative separation may imply that closed conditions, i.e., sterility and/or containment, are established between the separated devices. The integrity of the process line should be maintained independent of operative separation, i.e., the permanent connection between the devices via the transfer section is not affected.

According to various embodiments of the invention, at least one of the process devices and one of the transfer sections may comprise a confining wall which is adapted for providing predetermined process conditions (i.e., physical or thermodynamical conditions such as temperature, pressure, humidity, etc.) within a confined process volume, wherein the confining wall is adapted for isolating the process volume and an environment of the process device from each other. Irrespective of whether the confining wall comprises further structures such as tubes or similar "inner walls" confined within the process volume, the confining wall has to fulfill both functions simultaneously, i.e., besides maintaining desired process conditions in the process volume, the wall has to adopt simultaneously the functionality of a conventional isolator. No further isolator(s) is/are therefore required for a process line according to these embodiments of the invention. Conventional isolators are typically not appropriate for use in process devices according to the invention. In certain embodiments at least a wall of an isolator is adapted such that it can simultaneously ensure desired process conditions inside, thereby defining the inside of the isolator as the "process volume." Similarly, a conventional standard device would not be appropriate for use as a process device according to the invention: a wall thereof defining in the inside a process volume would at least have to be adapted such that it can simultaneously ensure isolation of the process volume and environmental separation of the process devices from each other.

In one example, a transfer section according to the invention may comprise a confining wall which permanently or non-permanently interconnects process devices to enable a closed operation (i.e., the connection may be in place at least during a process phase comprising a product transfer between the connected devices). The confining wall may isolate an inside volume such as a process volume (which may for example be sterile), from an outside volume such as an environment of the process line the transfer section is a part of (which may not be, and need not be sterile). In this regard, the confining wall simultaneously enables maintenance of desired process conditions within the process volume. The term "process conditions" is intended to refer to the temperature, pressure, humidity, etc. in the process volume, wherein a process control may comprise controlling or driving such process conditions inside the process volume according to a desired process regime, for example, according to a time sequence of a desired temperature profile and/or pressure profile). While the "closed conditions" (sterile conditions and/or containment conditions) also are subject to process control, these conditions are discussed herein in many cases explicitly and separately from the other process conditions indicated above.

In further embodiments, the transfer section may comprise, extending within the process volume, a conveyance mechanism such as a tube for achieving the product transfer. In one such embodiment, the transfer section has a "double-walled" configuration, wherein the outer wall implements a confining wall and the inner wall implements a tube. This double-walled transfer section differs from a tube included in a conventional isolator in that the confining wall is adapted for enabling the desired process conditions in the process volume. In the case of a permanent connection, the confining wall can permanently interconnect the process devices, while the inner wall (tube, etc.) may or may not be in place permanently. For example, the tube may extend into a connected freeze-dryer, e.g., a drum thereof; the tube may be withdrawn from the freeze-dryer/tube as soon as a loading of the freeze-dryer/tube is completed. Irrespective of such configurations, closed operating conditions can be maintained by the outer (confining) wall.

A confining wall of a process device or transfer section, which is adapted to function as a conventional isolator and in order to further simultaneously provide for a process volume according to the invention, has to conform to a plurality of process conditions including, but not limited to, providing and maintaining a desired temperature regime, and/or pressure regime, etc. For example, according to prescriptions such as GMP requirements, a sensor system could be used in order to determine that sterile conditions and/or containment conditions are in place/being maintained. As another example, for efficient cleaning and/or sterilization (e.g., Cleaning in Place "CiP" and/or Sterilization in Place "SiP"), there may be the requirement that a confining wall of a process device/transfer section be designed in order to avoid as far as possible critical areas which may be prone to contamination/pollution and difficult to clean/sterilize. In still another example, there may be the requirement that a process device/transfer section be specifically adapted for efficient cleaning and/or sterilization of inner elements, such as the "inner wall" or tube mentioned in the above-discussed specific example transfer section. All such features are not met by conventional isolators.

The process devices, including the spray chamber, the freeze-dryer and optionally further devices, and one or more transfer sections connecting the devices can form an integrated process line providing end-to-end protection of the sterility of the product. Additionally or alternatively, the process devices and the transfer section(s) can form an integrated process line providing end-to-end containment of the product.

Embodiments of the spray chamber may comprise any device adapted for droplet generation from a liquid and for freeze congealing of the liquid droplets to form particles, wherein the particles preferably have a narrow size distribution. Exemplary droplet generators include, but are not limited to, ultrasonic nozzles, high frequency nozzles, rotary nozzles, two-component (binary) nozzles, hydraulic nozzles, multi-nozzle systems, etc. Freezing can be achieved by gravity fall-down of the droplets in a chamber, tower, or tunnel. Exemplary spray chambers include, but are not limited to, prilling devices such as prilling chambers or towers, atomization devices such as atomization chambers, nebulization/atomization and freezing equipment, etc.

According to one embodiment of the invention the spray chamber is adapted for separation of the product from any cooling circuit. The product can be kept separate from any primary circulating cooling/freezing medium or fluid, including gaseous or liquid media. According to one variant of this embodiment, an inner volume of the spray chamber comprises a non-circulating optionally sterile medium such as nitrogen or a nitrogen/air mixture and a temperature-controlled, i.e., cooled inner wall as the only cooling component for freezing the droplets, such that a counter- or concurrent cooling flow can be avoided.

According to one embodiment of the invention, the freeze-dryer can be adapted for separated operation (i.e., an operation which is separate or distinct from the operation or non-operation of other process devices) under closed conditions, wherein the separated operation includes at least one of particle freeze-drying, cleaning of the freeze-dryer, and sterilization of the freeze-dryer.

In one embodiment of the process line, the freeze-dryer can be adapted for a direct discharge of the product into a final recipient under closed conditions. The recipient may comprise, for example, a container such as an Intermediate Bulk Container ("IBC") for temporary stockpiling or storage of the product for subsequent mixing into a final formulation, filling into final recipients, further processing, or the recipient may comprise a final recipient such as a vial for final filling, and/or the recipient may comprise a sample vessel for sampling. Other subsequent dispositions of the product are also possible and/or the recipient may also comprise still another storage component. According to one variant of this embodiment, the freeze-dryer can be adapted for a direct discharge of the product into the final recipient under protection of sterility of the product. The freeze-dryer may comprise a docking mechanism allowing a docking and undocking of recipients under protection of sterility conditions and/or containment for the product.

The integrated process line may comprise as a further device, besides the spray chamber and the freeze-dryer, such as a product handling device, which is adapted for at least one function of discharging the product from the process line, taking product samples, and/or manipulating the product under closed conditions. Besides the transfer section (generally, one or more transfer sections) permanently connecting the spray chamber and the freeze-dryer, a further transfer section (generally, one or more transfer sections) can be provided for product transfer from the freeze-dryer to the product handling device, wherein for the production of the particles under end-to-end closed conditions each of the further transfer sections and the product handling device is separately adapted for closed operation. The further transfer section can permanently connect the freeze-dryer to the product handling device such that the product handling device can form part of the integrated process line for the production of the particles under end-to-end closed conditions.

In some embodiments, the spray chamber is adapted for separating product flow from any cooling circuit(s) for the freeze congealing of the product. Additionally or alternatively, the spray chamber may comprise at least one temperature-controlled wall for freeze congealing the liquid droplets. The spray chamber can optionally be a double-walled spray chamber.

The freeze-dryer can be a vacuum freeze-dryer, i.e., it can be adapted for operation under a vacuum. Additionally, or alternatively, the freeze-dryer may comprise a rotary drum for receiving the particles.

At least one of the one or more transfer sections of the integrated process line can be permanently mechanically mounted to the devices connected to it. At least one of the one or more transfer sections of the process line can be adapted for a product flow comprising a gravity transfer of the product. The present invention is however not limited to transferring product through the process line only by action of gravity. Indeed, in certain embodiments, the process devices, and transfer section(s) in particular, are configured to provide mechanical transfer of the product through the process line using one or more of conveyor components, auger components, and the like.

One or more of the transfer sections of the process line may comprise at least one temperature-controlled wall. At least one of the one or more transfer sections of the integrated process line may comprise a double wall. Additionally, or alternatively, at least one of the one or more transfer sections of the process line may comprise at least one cooled tube. In the case where the freeze-dryer comprises a rotary drum, the transfer section connecting the spray chamber and the freeze-dryer can protrude into the rotary drum. For example, a transfer tube of the transfer section may protrude into the drum, wherein a (transfer) tube included in a transfer section is generally to be understood as an element adapted for conveyance of the product or achieving a product flow, i.e., a product transfer between process devices, e.g., from one process device to another process device.

The process line may comprise a process control component adapted for controlling operative separation and subsequent separate operation of one of at least two process devices of the process line. In certain of the these embodiments, the process control component comprises one or more of the following: a module for controlling a separating element such as a valve or similar sealing element arranged at a transfer section for separating the devices, a module for determining whether closed conditions (for example, sterility or containment conditions) are established in at least one process volume provided by at least one of the devices, and a module for selectively controlling process control equipment related to the one separated process device.

In particular embodiments, the entire integrated process line (or portions thereof) can be adapted for CiP and/or SiP. Access points for introduction of a cleaning medium and/or a sterilization medium including, but not limited to, use of nozzles, steam access points, etc., can be provided throughout the devices and/or the one or more transfer sections of the process line. For example, steam access points can be provided for steam-based SiP. In some of these embodiments, all or some of the access points are connected to one cleaning and/or sterilization medium repository/generator. For example, in one variant, all steam access points are connected to one or more steam generators in any combination; for example, exactly one steam generator may be provided for the process line. In cases where, for example, a mechanical scrubbing should be required, this could be included within a CiP concept for example by providing a correspondingly adapted robot, such as a robotic arm.

According to another aspect of the invention, a process line for the production of freeze-dried particles under closed conditions is proposed, which is performed by a process line as outlined above. The process comprises at least the steps of generating liquid droplets and freeze congealing the liquid droplets to form particles in a spray chamber, transferring the particles under closed conditions from the spray chamber to a freeze-dryer via a transfer section, and freeze-drying the particles as bulkware in the freeze-dryer. For the production of the particles under end-to-end closed conditions, each of the devices and the transfer section(s) are separately adapted for operation preserving sterility of the product to be freeze-dried and/or containment. The product transfer to the freeze-dryer can optionally be performed in parallel to droplet generation and freeze-congealing in the spray chamber.

The process may comprise the further step of operatively separating the spray chamber and the freeze-dryer after completion of a batch production in the spray chamber and transfer of the product to the freeze-dryer. Additionally, or alternatively, the process may comprise a step of operatively separating the spray chamber and the freeze-dryer to perform CiP and/or SiP in one of the separated devices. The step of operatively separating the spray chamber and the freeze-dryer may comprise controlling a vacuum-tight valve in the transfer section (generally, one or more transfer sections) connecting the two devices.

Advantages of the Invention

Various embodiments of the present invention provide one or more of the advantages discussed herein. For example, the present invention provides process lines for the production of freeze-dried particles under closed conditions. Sterile and/or contained product handling is enabled while avoiding the necessity of putting the entire process line into a separator or isolator. In other words, a process line according to the invention adapted for example for an operation under sterile conditions can be operated in an unsterile environment. The costs and complexity related to using an isolator can therefore be avoided while still conforming to sterile and/or containment requirements, for example GMP requirements. For example, there may be an analytical requirement of testing in regular time intervals (e.g., every hour or every few hours) whether sterile conditions are still maintained inside an isolator. By avoiding such costly requirements, production costs can be considerably reduced.

According to one embodiment of the invention, each of the process devices of a process line such as a spray chamber and a freeze-dryer as well as any transfer section(s) connecting the devices for achieving a product flow between the devices under closed conditions, are separately adapted for closed operation. Each device/transfer section can be individually adapted and optimized for achieving, protecting and/or maintaining closed operation conditions.

According to various embodiments of the invention, in an integrated process line the product flow runs interface-free from end-to-end, e.g., from entry of a liquid to be prilled into the process line to discharge of the particles out of the line. "Interface-free" in this respect is to be understood as describing an uninterrupted flow of product without breaks such as, for example, unloading of the product into one or more intermediate receptacles, transfers thereof, and reloading of the product from the receptacles, as would be required for a process line contained within two or more isolators.

Embodiments of the invention avoid several of the disadvantages of highly integrated concepts wherein all process functions are implemented within one device. The invention-allows flexible process line operation. Transfer sections are adapted for operatively separating one or more connected devices thus enabling independent control of the operational mode of each respective device. For example, while one device operates for particle production, another device is operated for maintenance, e.g., washing, cleaning or sterilization. The possibility of operative separation provides in-process control of relevant process and/or product parameters.

Additionally, or alternatively, an embodiment of a process line according to the invention can be operated entirely or in segments (down to device level) in continuous, semi-continuous, or batch mode. For example, a (quasi-) continuous prilling process can result in continuous flow of product into the freeze-dryer which in turn is set to perform drying of the received product in batch mode operation. As operations of different devices are separable, the control of the process line preferably is correspondingly flexible as well. Keeping with the above example, the freeze-dryer can operate in parallel to the operation of the prilling process, or start operating only after the prilling process has finished. Generally, "end-to-end closed conditions" are provided according to the invention independent of the respective mode configured for the process line or parts thereof. In other words, "end-to-end" protection of sterility and/or process containment is provided independent of whether the product is processed in any combination of continuous, semi-continuous, or batch mode operations throughout the process line.

Certain preferred embodiments of a process line according to the invention allow further decoupling of the different process devices. For example, a transfer section connecting a spray chamber and a freeze-dryer may comprise at least one temporary storage component. A continuous product flow from the spray chamber can then be terminated in the temporary storage. The temporary storage is opened towards the freeze-dryer for allowing product transfer of the product temporarily collected and stored in the storage towards the freeze-dryer only once a previous batch has been unloaded from the freeze-dryer or the freeze-dryer is otherwise ready for processing the batch collected and stored in the temporary storage. Such temporary storage thus also allows controlling (defining, limiting, etc.) a batch size.

Separate process devices, although being operable under (optionally end-to-end) closed conditions, can be separately optimized for example for efficiency, robustness, reliability, physical process or product parameters, etc. Individual process steps can separately optimized. For example, the freeze-drying process can be optimized by employing a rotary drum freeze-dryer in order to achieve a very fast drying process in comparison to conventional freeze-drying in highly integrated single-device process "lines" including variants of tray-based freeze-drying. Use of a bulkware freeze-dryer avoids the necessity to use specific vials, vessels or other kind of containers. In many conventional freeze-dryers, specifically adapted containers (vials, etc.) are required for the particular freeze-dryer, for example, specific stoppers for the passage of water vapor may be required. No such specific adaptions are required for embodiments of the invention.

The invention allows process lines to be easily adapted to different applications. Separate process devices (can be adapted for a production under closed conditions) and can then be employed according to the invention. In certain embodiments, the devices can be permanently interconnected with transfer sections. This allows a cost-efficient design of process lines for sterile and/or contained bulkware (e.g., micropellet) production. It is possible to provide a "construction kit" of process devices including, e.g., spray chamber and freeze-dryer devices, which are previously generally adapted for operation under closed conditions, and to combine those devices as desired for any specific application.

Compared to WO 2006/008006 A1, for example, that teaches gates through which the product has to be transported in bins or containers from one isolator to the next, the present invention preferably provides specific process lines having end-to-end hermetically closed conditions for product flow, such that the interfaces between the devices do not require intermediate transportation of the product in bins or containers but the transfer sections are operable to either not disturb the end-to-end product flow, or to separate the devices without affecting the integrity of the process line.

In particular embodiments, once the desired devices are assembled, and permanently interconnected with one or more transfer sections, there is no need for violating the mechanical and/or constructional integrity of the process line. For example, the devices and transfer sections of the closed process line can easily be adapted for automatic washing, cleaning, and/or sterilization in place (WiP, CiP and/or SiP), thereby avoiding the necessity for manual cleaning which would include disassembling two or more parts of the process line.

A process line according to the invention enables the efficient production of freeze-dried particles as bulkware In one embodiment, liquid is introduced at the start of the process line and sterile dried particles are collected at the terminus of the process line. This enables the production of sterile lyophilized uniform calibrated (micro)particles as bulkware, wherein the resulting product can be free-flowing, dust-free, and homogenous. The resulting product therefore comes with good handling properties and can be combined with other components that might be incompatible in liquid form or only stable for a short period of time and thus not suitable for conventional freeze-drying techniques.

The invention therefore allows a separation of the final filling of the dosage form from the previous drying process thus allowing filling-on-demand and/or dosing-on-demand performance because the time-consuming manufacture of bulkware can be performed prior to the filling and/or particular dosing of an API. Costs can be reduced and specific requirements can be more easily satisfied. For example, in particular embodiments, different filling levels are readily achieved since different final specifications do not require additional liquid filling and subsequent drying steps.

According to various embodiments, process lines adapted for sterile processing do not require direct contact of the product with a cooling medium (e.g., liquid or gaseous nitrogen). For example, the spray chamber can be adapted to separate the product flow from a primary cooling circuitry. Consequentially, a sterile cooling medium is not required. It is possible to operate certain process lines without the use of silicone oil.

The invention is applicable for process lines for production of many formulations/compositions suitable for freeze-drying. This may include, for example, generally any hydrolysis-sensitive material. Suitable liquid formulations include, but are not limited to, immunological compositions including vaccines, therapeutics, antibodies (e.g., monoclonal), antibody portions and fragments, other protein-based APIs (e.g., DNA-based APIs, and cell/tissue substances), APIs for oral solid dosage forms (e.g., APIs with low solubility/bioavailability), fast dispersible or fast dissolving oral solid dosage forms (e.g., ODTs, orally dispersible tablets), and stick filled presentations, etc.

DESCRIPTION OF THE FIGURES

Further aspects and advantages of the invention will become apparent from the following description of particular embodiments illustrated in the figures in which.

DETAILED DESCRIPTION OF PREFERRED EMBODIMENTS

Figure 1:
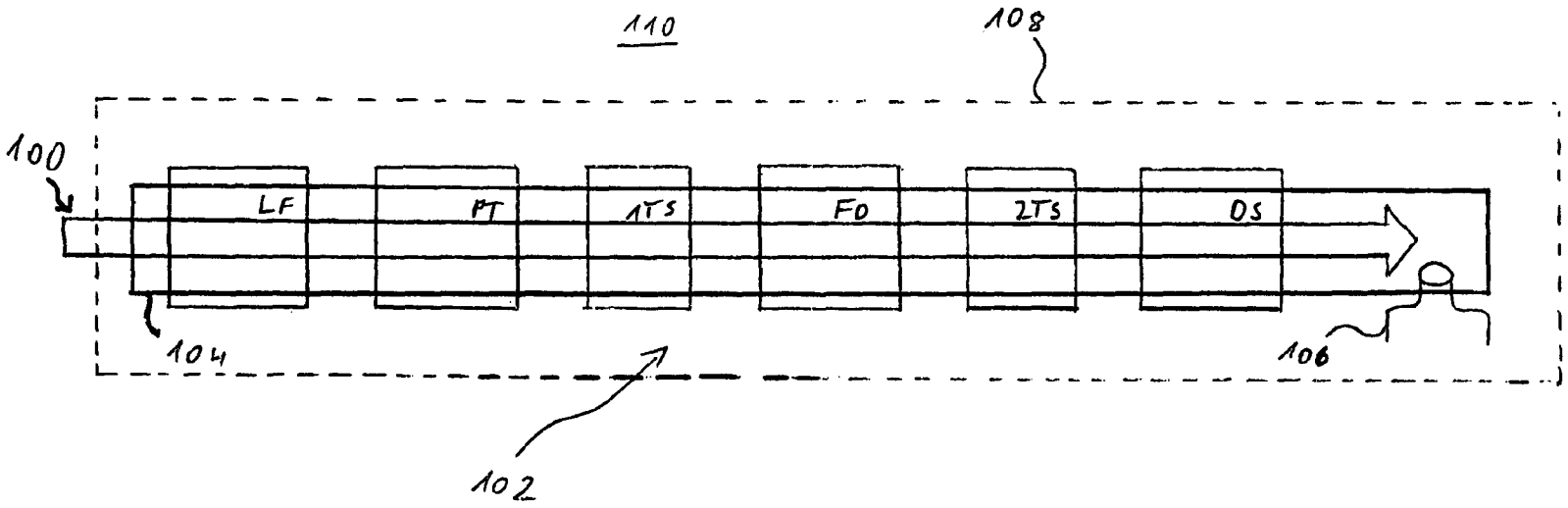
FIG. 1 is a schematic illustration of one embodiment of a product flow in a process line according to the invention.

FIG. 1 schematically illustrates a product flow 100 assumed to pass through a process line 102 for the production of freeze-dried pellets under closed conditions 104. A liquid feeding section (LF) feeds liquid to a prilling chamber/tower (PT) where it is subjected to droplet generation and freeze-congealing. The resulting frozen pellets are then transferred via a first transfer section (1TS) to a freeze-dryer (FD) wherein the frozen droplets are lyophilized. After lyophilization, the produced pellets are transferred via a second transfer section (2TS) to a discharge station (DS) which provides for a filling under closed conditions into final recipients 106 which are then removed from the process line.

Closure 104 is intended to indicate that the product flow 100 from entry to exit of process line 102 is performed under closed conditions, i.e., the product is kept under sterility and/or containment. In preferred embodiments, the process line provides closed conditions without the use of an isolator (the role of which is as indicated by dashed line 108 which separates line 100 from environment 110). Instead, closure 104 separates product flow 100 from environment 110, wherein closure 104 (closed conditions) is/are implemented individually for each of the devices and transfer sections of process line 102. Further, the goal of end-to-end protection of sterility and/or containment is achieved without putting the entire process within one single device. Instead, the process line 100 according to the invention comprises separate process devices (e.g., one or more PTs, FDs, DSs, etc.) which are connected as indicated in FIG. 1 by one or more transfer sections (e.g., 1TS, 2TS, etc.) to form integrated process line 102 enabling the interface-free end-to-end (or start-to-end) product flow 100.

Figure 2A:
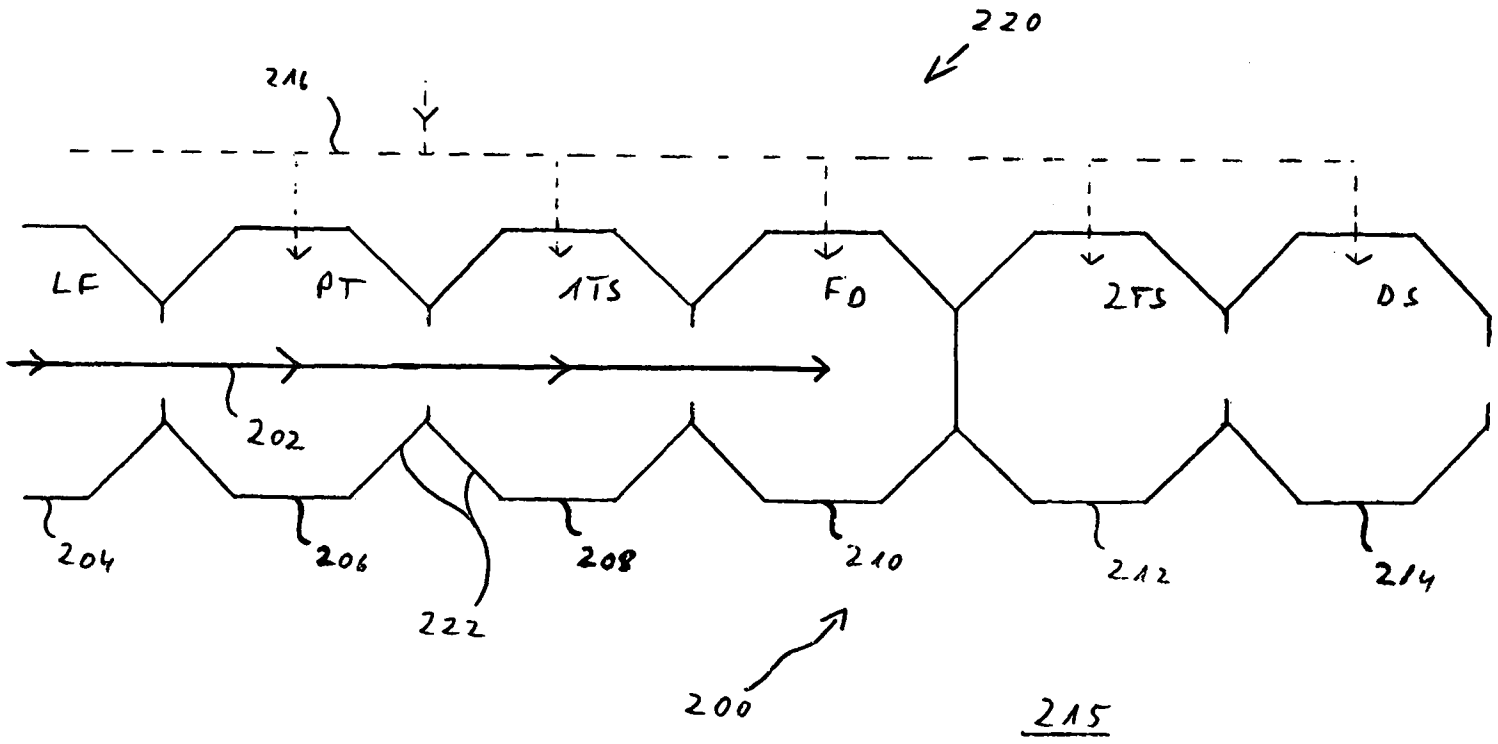
FIG. 2*a* is a schematic illustration of a first embodiment of a configurational mode of a process line according to the invention.

FIG. 2*a* schematically illustrates a configuration of a process line 200 for the production of freeze-dried pellets (micropellets) under closed conditions. Briefly, product flows as indicated by arrow 202 and is preferably kept sterile and/or contained by accordingly operating each of the separate devices including LF, PT, FD and transfer section 1TS under sterile conditions/containment, which is intended to be indicated by enclosures 204, 206, 208, and 210. The discharge station DS, while not currently under operation, is also adapted for protecting sterility/providing containment 214. In the exemplary configuration of the process line 200, as illustrated in FIG. 2*a*, the first transfer section (1TS) is configured in an open position not to limit or interfere with the product flow 202, while the second transfer section (2TS) is configured to sealably separate the freeze-dryer (FD) and discharge station (DS), i.e., 2TS operates to seal the FD and provides closed conditions 212 in this respect. Each of the devices, e.g., PT, FD, etc., and the transfer sections, e.g., 1TS and 2TS, are separately adapted and optimized for operation under closed conditions, wherein "operation" refers to at least one mode of operation including, but not limited to, production of freeze-dried pellets, or maintenance modes (for example, a sterilization of a process device or transfer section naturally also requires that the device/section is adapted to maintain sterility/containment).

The details of how process devices such as PTs or FDs can protect sterility/provide containment for the products processed therein depend on the specific application. For example, in one embodiment, the sterility of a product is protected/maintained by sterilizing the involved process devices and transfer sections. It is to be noted that a process volume confined within a hermetically closed wall will after a sterilization process be considered sterile during a given time under particular processing conditions, such as, but not limited to, processing of the product under slight excess (positive) pressure compared to an environment 215. Containment can be considered to be achieved by processing the product under slightly lowered pressure compared to the environment 215. These and other appropriate processing conditions are known to the skilled person.

As a general remark, transfer sections such as 1TS and 2TS depicted in FIG. 2*a* are designed to ensure that product flow through them is accomplished under closed conditions; this includes the aspect that closed conditions have to be ensured/maintained also for a transition of product into and out of the transfer section; in other words, an attachment or mounting of a transfer section to a device for achieving a product transfer has to preserve the desired closed conditions.

Figure 2B:
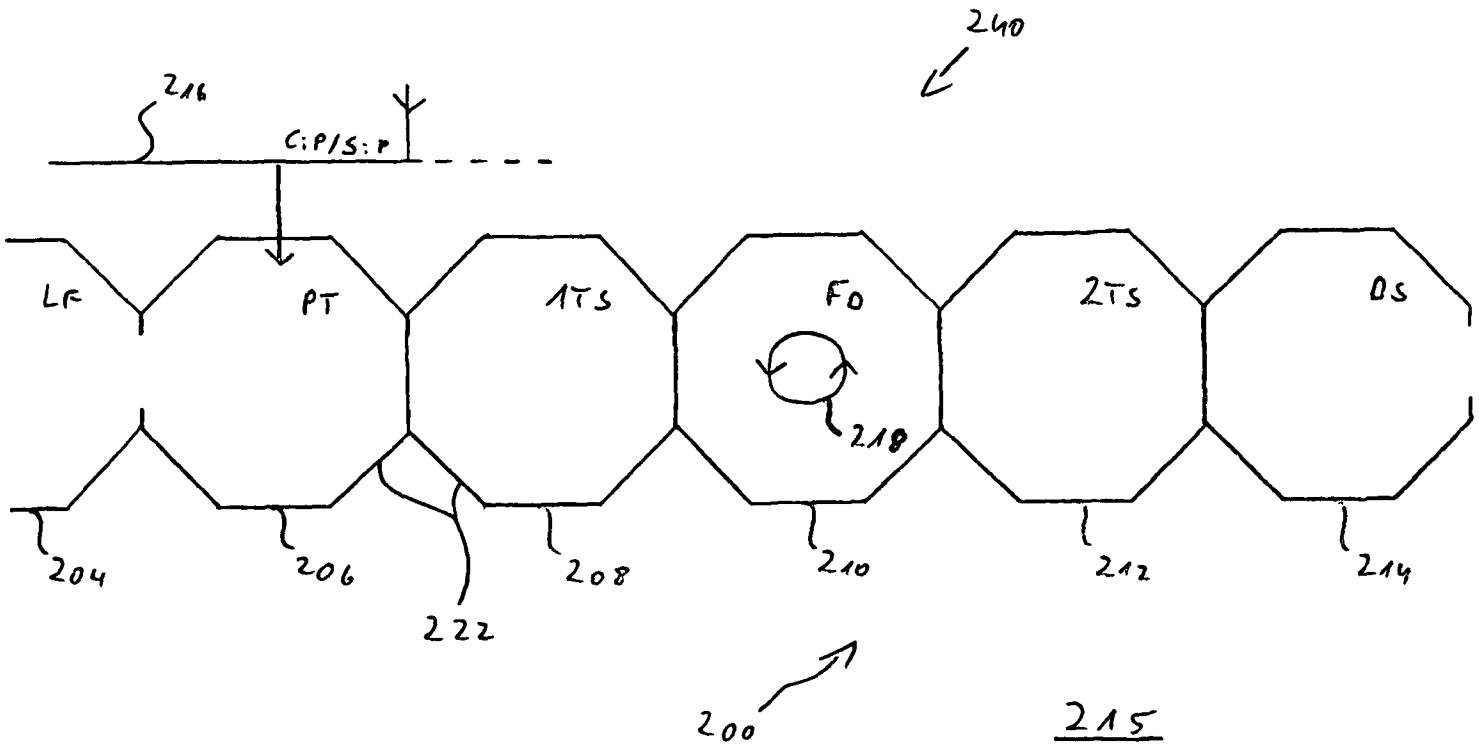
FIG. 2*b* is a schematic illustration of a second embodiment of a configurational mode of a process line according to the invention.

FIG. 2*b* illustrates the process line 200 of FIG. 2*a* in a different operational configuration 240, which may be controllably arrived at in a time sequence after the configuration depicted in FIG. 2*a*. Both transfer sections 1TS and 2TS are switched for operatively separating the corresponding interconnected process devices from each other. Liquid feeding section (LF) 204 and prilling tower (PT) 206 therefore form a closed subsystem which is separated under conditions of sterility and/or containment: (1) from the environment 215; and (2) from those parts of process line 200 separated by 1TS 208.

Similarly, FD 210 forms a further closed subsystem which is separated: (1) from the environment 215; and (2) from the other adjoining process devices separated by 1TS 208 and 2TS 212. It is assumed that the process devices of process line 200 are optimized to be compliant with cleaning and/or sterilization CiP/SiP procedures. Correspondingly, a CiP/SiP system 216 is provided which includes a system of pipes for providing a cleaning/sterilization medium to each of the process devices. The piping system is indicated with dashed lines in FIG. 2*a*. The solid lines of system 216 in FIG. 2*b* are intended to indicate that in the operational configuration of process line 200 in FIG. 2*b* PT 206 is subjected to a CiP/SiP process. At the same time, freeze-dryer FD processes a batch of material (bulk product), as indicated by closed arrow 218. The discharging of freeze-dried pellets from FD to DS can occur discontinuously, which is why the transfer section 2TS is also closed during drying operation of the freeze-dryer FD in FIG. 2*a*.

As schematically indicated in the figures, the enclosures 204-214 provide an entirely closed "outer envelope" 222 encompassing the process line 200. The transfer sections 208 and 212 interconnect the process devices while maintaining closed conditions for the product transfer throughout the process line 200. The envelope 222 is unchanged from FIG. 2*a* to FIG. 2*b*, i.e., the envelope 222 is maintained independent of any specific process line configurations such as configurations 220 or 240 and in this way implements the goal symbolized by closure 104 in FIG. 1. Process line 200 is designed such that the interconnections implemented by transfer sections 208 and 212 are permanent in the sense that disconnecting (e.g., disassembling or removing) one or more of the transfer sections from one or more of the adjoining process devices connected thereto is not required for any process line configuration and operation. Thus, in some embodiments, one or more connections to process devices of one or more of the transfer sections can be intended to be permanent for the intended lifetime of the process line. For example, a permanent connection may include permanent mechanical fixings/mountings, for example by welded connections, riveted connections, but also bolted connections, industrial adhesives, etc. For example, as symbolized by CiP/SiP system 216 in FIGS. 2*a*, 2*b*, cleaning and/or sterilization of a process device or transfer section may not require any mechanical or manual intervention in that it is performed automatically in place throughout the process line or in parts (e.g., devices) thereof. Automatic control of the valves (or similar separating means) provided in association with the transfer sections (preferably by remote access thereto) also contribute to configurability of the process line 200 for different operational configurations without mechanical and/or manual intervention.

Figure 2C:
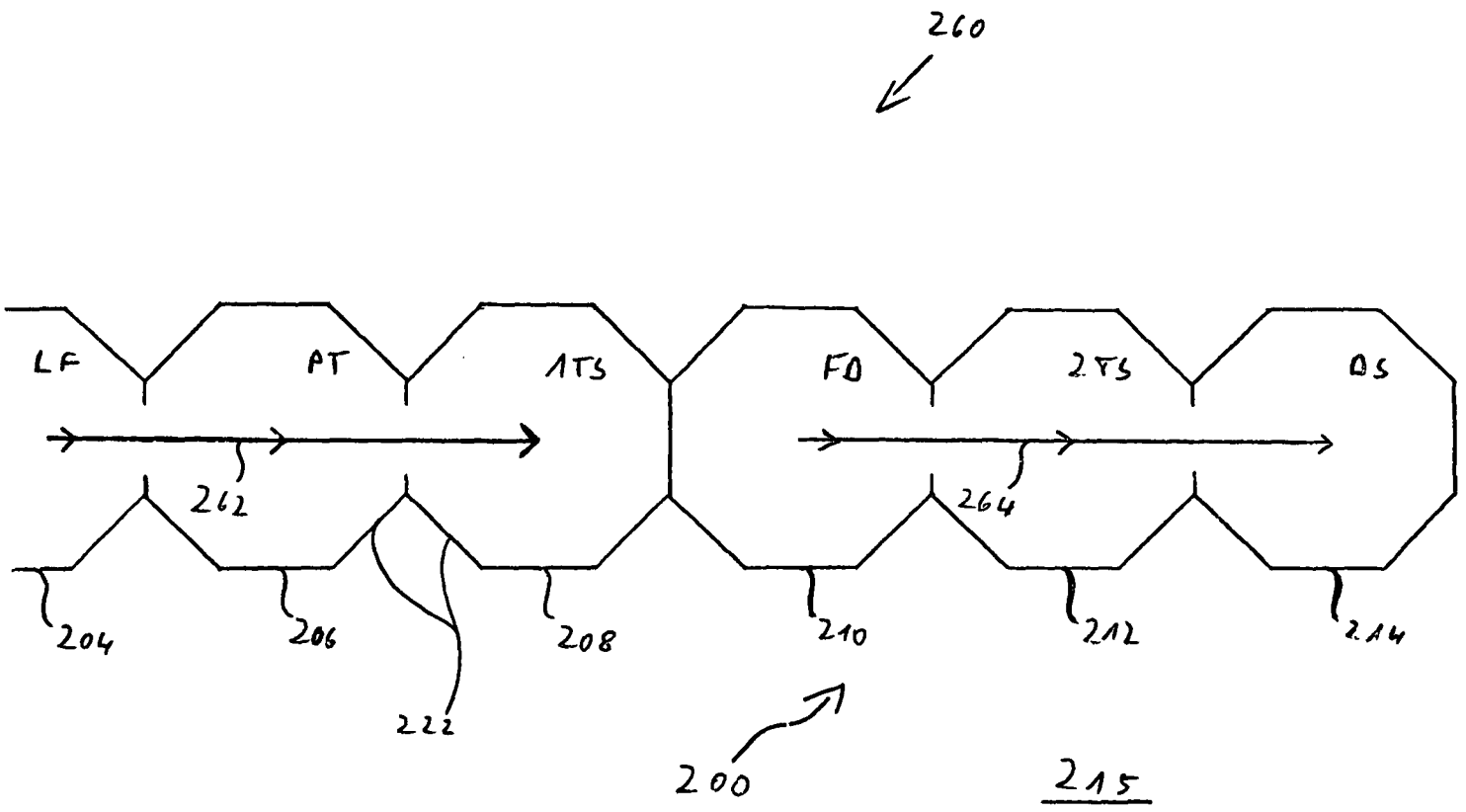
FIG. 2*c* is a schematic illustration of a third embodiment of a configurational mode of a process line according to the invention.

It is further to be noted that the closure envelope 222 of process line 200 depicted in FIGS. 2*a*, 2*b* and 2*c* results from each of the process devices (e.g., LF 204, PT 206, FD 210, and DS 214) and transfer sections (e.g., 1TS 208 and 2TS 212) of process line 200 being individually adapted for closed operation wherein one or more of the devices/sections can be individually optimized for sterility and/or containment conditions/operations. As a result, there is no requirement to use one or more isolators, as is typically required in conventional approaches for providing sterility and/or containment in conjunction with process devices such as PT 206, FD 210, and DS 214. The individual optimizations described herein provide more cost-efficient solutions for protecting sterility and/or providing containment as compared to conventional isolator-based systems. At the same time, according to the invention process devices such as PT, FD, and DS are provided as mechanically separate process devices and can therefore operate separately from each other. These and other embodiments of the invention allow for greater cost-effectiveness in comparison to conventional approaches such as specifically designed and highly-integrated single devices which have to be re-designed for new process requirements.

Figure 5:
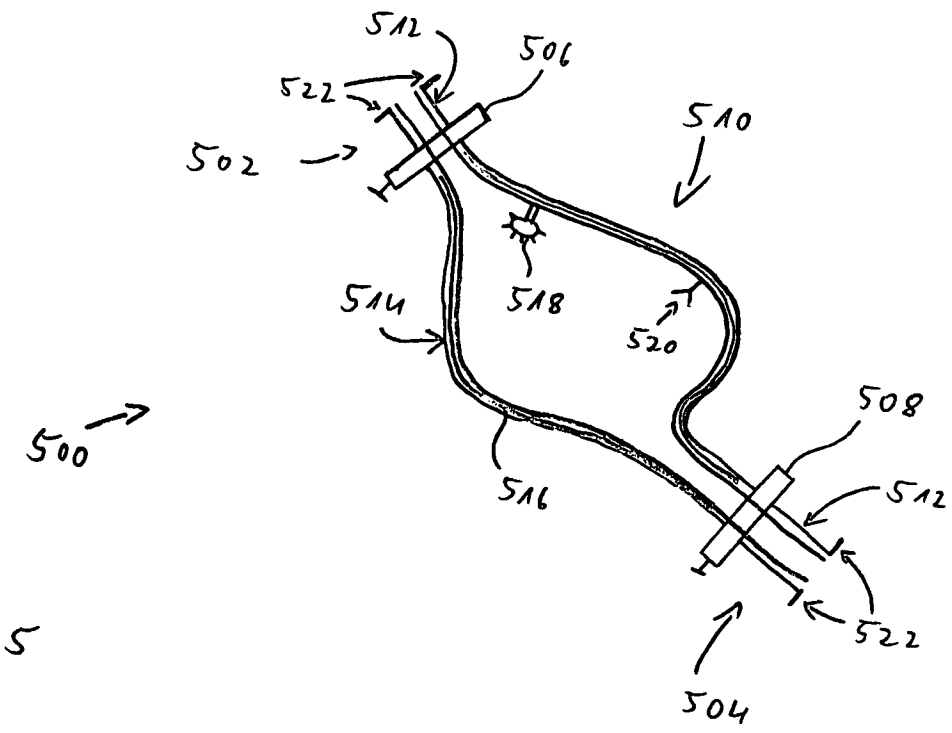
FIG. 5 an embodiment of a transfer section according to the invention.

FIG. 2*c* illustrates another operational configuration 260 of process line 200. Liquid feeding section (LF) 204 and prilling tower (PT) 206 operate to produce frozen product, e.g., micropellets, which are transferred via gravity into transfer section (1TS) 208. However, as opposed to configuration 220 in FIG. 2*a*, transfer section 1TS receives the product, but does not forward the product to the freeze-dryer FD. Instead, 1TS 208 is switched to operatively separate PT 206 and FD 210 from each other. Transfer section (1TS) 208 may be equipped with an intermediate storage component for receiving the frozen pellets from the PT 206 (a detailed example of an intermediate storage component is illustrated in FIG. 5). In this way, the production of prilling tower (PT) 206 can intermittently be stored within transfer section 1TS 208.

The configuration illustrated in FIG. 2*c* illustrates that the freeze-dryer (FD) 210 finished lyophilizing a batch of product (e.g., micropellets). The second transfer section (2TS) 212 has opened and thus enables transfer 264 of the freeze-dried product from the freeze-dryer (FD) 210 into the discharge station (DS) 214 for discharging. It is to be understood that in preferred embodiments the separate production cycles in the prilling tower (PT) 206 (illustrated as product flow 262) and in the freeze-dryer (FD) 210, respectively, are each performed under respectively closed conditions for each of the different products handled therein. As the transfer section 1TS is adapted for operatively separating prilling tower (PT) 206 and the freeze-dryer (FD) 210 from each other, different products can be processed in both process devices. Prior to a transfer of the frozen pellets from the intermediate storage of transfer section (1TS) 208, the freeze-dryer (FD) 210 would preferably be cleaned and/or sterilized (e.g., via CiP/SiP).

Generally, the process line 200 as variously depicted in FIGS. 2*a*-2*c* illustrates an embodiment of an integrated process line for the production of freeze-dried product (e.g., micropellets) under end-to-end closed conditions wherein the various process devices are permanently connected to each other, and wherein liquid can be fed into the system at one terminus of the process line, and the lyophilized product can be collected at the other terminus of the process line. If the flowable material (e.g., liquids and/or pastes) has been sterile and the process line 200 has been operated under sterile conditions, the dried product will also be sterile.

In various preferred embodiments, the process line 200 is permanently mechanically integrated, thus negating the requirements for disassembling the various process devices, which is conventionally required, e.g., after a production run for performing a cleaning/sterilization of the process line.

The design principles of process line 200 also allow for in-process-control of relevant process/product parameters since the devices can operatively be separated from each other (e.g., via the operation of one or more transfer sections) and can be run in different operational modes and/or process/product control modes can be performed and optimized individually for the separate process devices. The control facilities of process line 200 are preferably adapted to separately drive operational modes for each of the process devices and transfer sections of the line.

Figure 3:
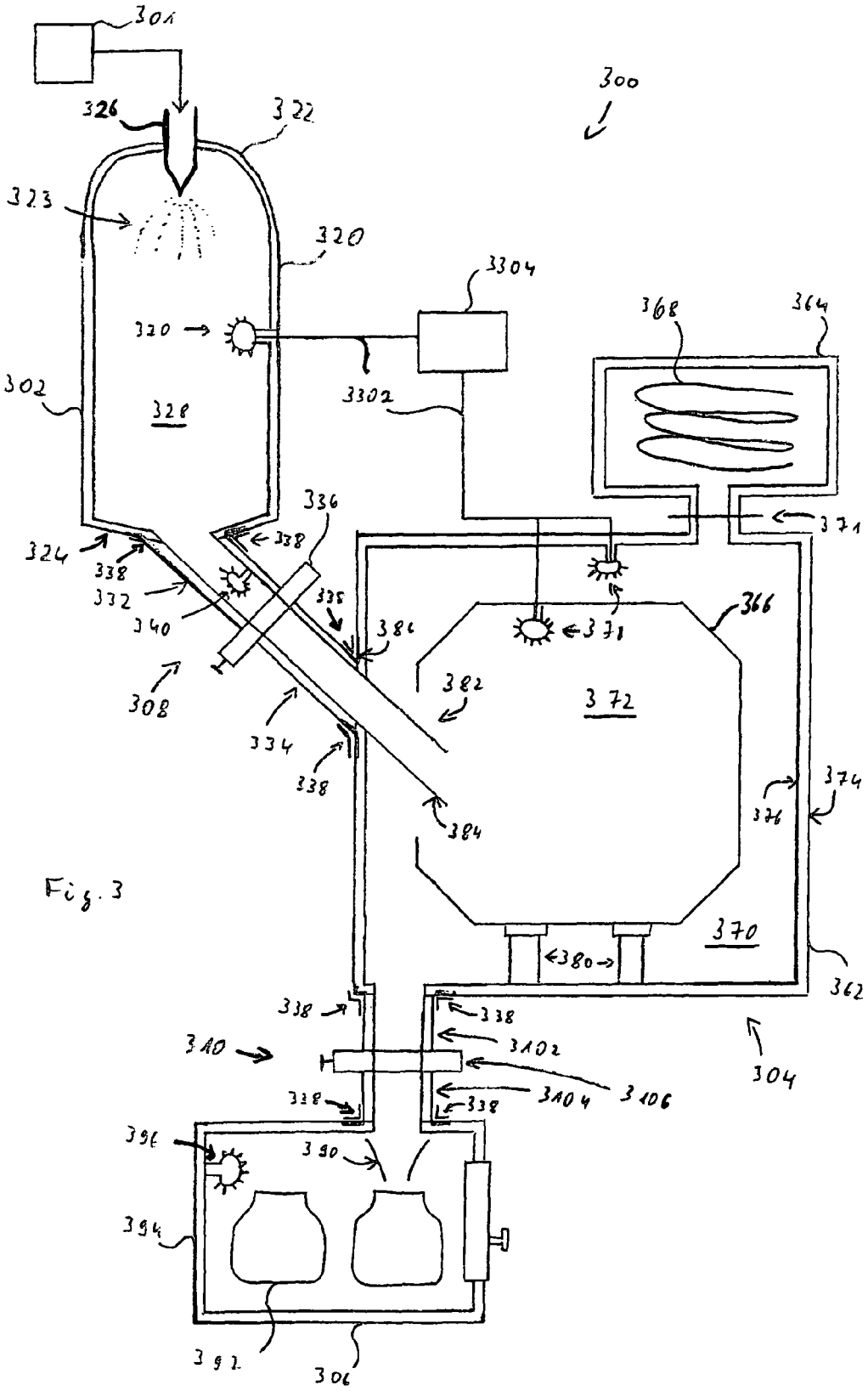
FIG. 3 schematically illustrates an embodiment of a process line according to the invention.

FIG. 3 illustrates one specific embodiment of a process line 300 designed according to the principles of the invention for the production of freeze-dried micropellets under closed conditions. The process line 300 generally comprises a liquid feeding section 301, prilling tower 302, as a specific embodiment of a spray chamber or spray-freezing equipment, a freeze-dryer 304, and a discharge station 306. In a preferred embodiment, prilling tower 302 and freeze-dryer 304 are permanently connected to each other via a first transfer section 308, while freeze-dryer 304 and discharge station 306 are permanently connected to each other via a second transfer section 310. Each of transfer section 308 and 310 provides for product transfers between the connected process devices.

The liquid feeding section 301 indicated only schematically in FIG. 3 is for providing the liquid product to the prilling tower 302. Droplet generation in the prilling tower 302 is affected by flow rate, viscosity at a given temperature, and further physical properties of the liquid as well as by the processing conditions of the atomizing process, such as the physical conditions of the spraying equipment including frequency, pressure, etc. Therefore the liquid feeding section 301 is adapted to controllably deliver the liquid and to generally deliver the liquid in a regular and stable flow. To this end, the liquid feeding section can include one or more pumps. Any pump may be employed which enables precise dosing or metering. Examples for appropriate pumps includes, but is not limited to, peristaltic pumps, membrane pumps, piston-type pumps, eccentric pumps, cavity pumps, progressive cavity pumps, Mohno pumps, etc. Such pumps may be provided separately and/or as part of control devices such as pressure damping devices, which can be provided for an even flow and pressure at the entry point into the droplet generation component of the prilling tower 302 (or more generally the spraying device). Alternatively, or additionally, the liquid feeding section may comprise a temperature control device for example, a heat exchanger, for cooling the liquid in order to reduce the freezing capacities required within the prilling tower. The temperature control device may be employed to control the viscosity of the liquid and in turn in combination with the feed rate the droplet size/formation rate. The liquid feeding section can include one or more flow meters, for example one flow meter per each nozzle of a multi-nozzle droplet generation system, for sensing the feed rate. One or more filtration components can be provided. Example for such filtration components include, but are not limited to, mesh-filters, fabric filters, membrane filters, and adsorption filters. The liquid feeding section can also be configured to provide for sterility of the liquid; additionally or alternatively, the liquid can be provided to the liquid feeding section pre-sterilized.

The freezing of droplets in a spray device such as prilling tower 302 may be achieved, for example, such that the diluted composition, i.e., the formulated liquid product, is sprayed and/or prilled. "Prilling" may be defined as a (for example, frequency-induced) break-up of a constant liquid flow into discrete droplets. Prilling does not exclude use of other droplet generation techniques such as use of hydraulic nozzles, two-component nozzles, etc. Generally, the goal of spraying and/or prilling is to generate calibrated droplets with diameter ranges for example from 200 μM to 1500 μm, with a narrow size distribution of +/−25%, more preferably +/−10%. The droplets fall in the prilling tower in which a spatial temperature profile is maintained with, for example a value of between −40° C. to −60° C., preferably between −50° C. and −60° C., in a top area and between −150° C. to −192° C., for example between −150° C. and −160° C., in a bottom area of the tower. Lower temperatures ranges can be obtained in the tower by alternative cooling systems for example, a cooling system using helium The droplets freeze during their fall in order to form preferably round, calibrated frozen particles (i.e., micropellets).

Specifically, the prilling tower 302 preferably comprises side walls 320, a dome 322 and a bottom 324. The dome 322 is equipped with a droplet generation system 326 according to one or more of the aspects discussed above and may for example comprise one or more nozzles for generation of droplets from a liquid (e.g., via "atomization") provided to the system 326 from the liquid feeding section 301. The droplets are frozen on their way down to the bottom 324.

Figure 4:
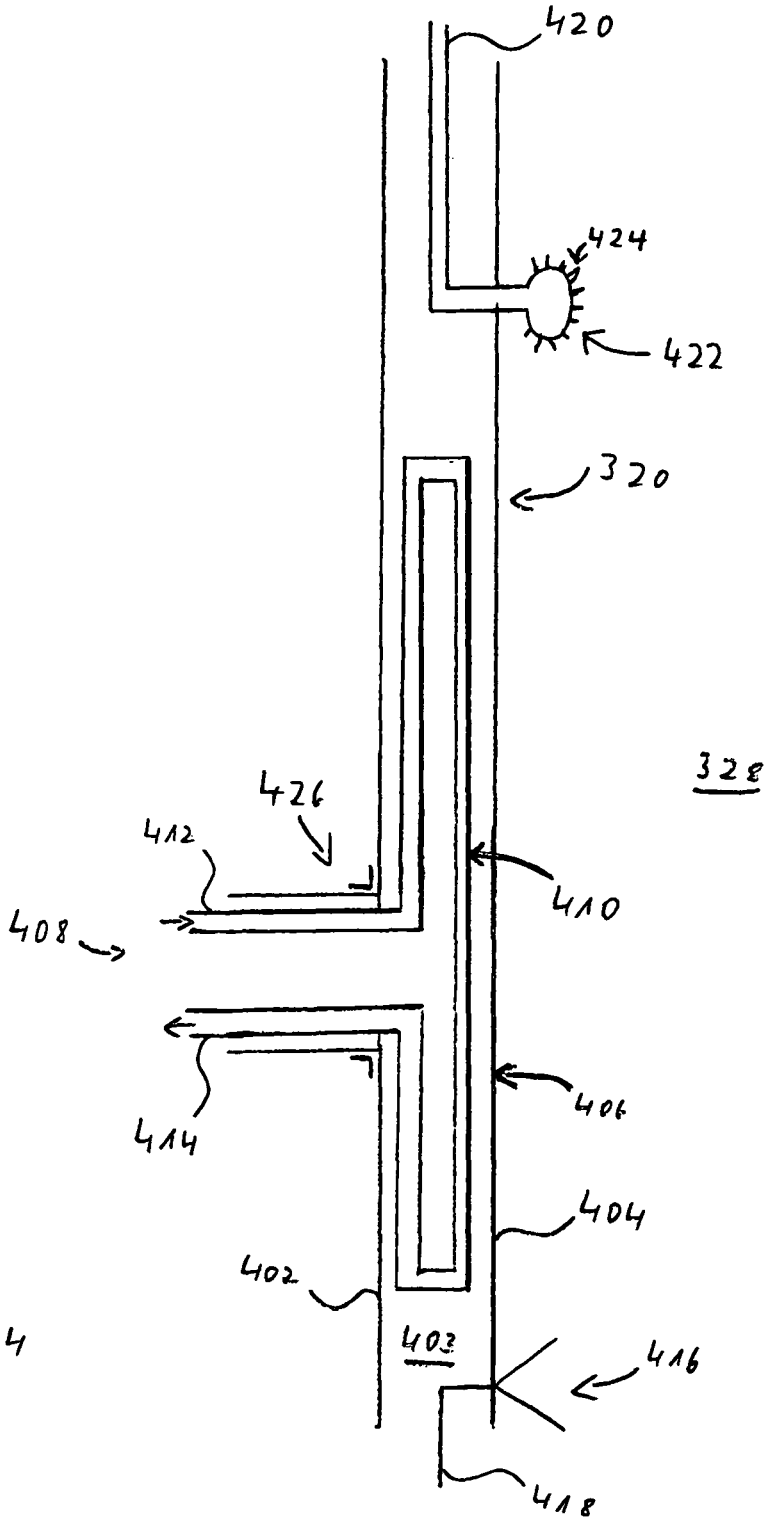
FIG. 4 an enlarged cut-out of the prilling tower of FIG. 3.

A cut-out illustration of a particular embodiment of prilling tower wall 320 is depicted in FIG. 4. Preferably, wall 320 comprises a double wall comprising outer wall 402 and inner wall 404 with internal volume 403 defined therein. The inner wall 404 has an inner surface 406 encompassing inner volume 328 of prilling tower 302 (cf. FIG. 3). For cooling the volume 328, the inner wall 404 (more precisely inner wall surface 406) is cooled by a cooling circuitry 408, which, as shown in FIG. 4, preferably comprises a tube system 410 extending throughout at least a part of internal volume 403 and being connected between a cooling medium inflow 412 and cooling medium outflow 414. Inflow 412 and outflow 414 can be connected to an external cooling medium reservoir that in turn comprises further equipment such as pumps, valves, and control circuitry 415 and/or instrumentation (which may e.g., be computer-controlled) as required for a specific process. The control circuitry 415 comprises sensor equipment 416 arranged at inner wall 404 for sensing conditions within inner volume 328, the equipment 416 connected via sensor linings (lines) 418 (e.g., one or more electrically conducting wires, fiber optic cables, etc.) to remote control components of the control circuitry.

As generally shown in FIG. 4, internal volume 403 inside double wall 320 houses cooling circuitry 408, sensor (linings) 418, and optionally sterilization piping 420 providing sterilization medium supply for sterilization medium access points 422. Steam can be used as a sterilization medium which is supplied via piping pipes 420 and enters inner volume 328 of the prilling tower for sterilization of, for example, inner wall surface 406 via one or more appropriately provided (sterilization) heads 424 at access points 422. The sterilization heads 424 can, for example, comprise a plurality of nozzles (or jets) 426 enabling the introduction of one or more appropriate sterilization mediums and potentially other fluids or gases into prilling tower 302. Running linings 418, tubing 408, and/or piping 420 inside double wall 320 are designed to minimize the number of openings 426 into outer wall 402 and therefore contribute to efficiently maintaining closed conditions, i.e., sterility and/or containment inside prilling tower 302 and thus internal volume 328.

Cooling the inner volume 328 of prilling tower 302 sufficient for freezing the falling droplets 323 (cf. FIG. 3) can be achieved by means of cooling the inner wall surface 406 via cooling medium conducting tubing 408 and providing the prilling tower 302 with an appropriate height. Therefore, a counter- or concurrent flow of cooled gas in internal volume 328 or other measure for direct cooling of falling droplets 323 is avoided. By avoiding contact of a circulating primary cooling medium such as a counter- or concurrent flow of gas with the falling product 323 in internal volume 328 of prilling tower 302, the need to provide a costly sterile cooling medium is avoided when sterile production runs are desired. The cooling medium circulating outside inner volume 328, for example in tubing 408, need not be sterile. The present invention contemplates that the double-walled prilling tower and cooling apparatuses described in some of the preferred embodiments herein will allow operators to achieve considerable cost-savings over existing prilling-tower designs. In this way, the prilling tower 302 can be adapted for separating of the product flow, i.e., the droplets 323 passing through inner volume 328, from the (primary) cooling circuit embodied as tubing 408 and the cooling medium circulating therein for freeze-congealing the liquid droplets 323. However, in still other embodiments, direct cooling and freeze-congealing of the droplets 323 via a (sterile) cooling medium using typical prilling schemes is also contemplated. For example, a direct cooling medium could be recirculated in a closed loop in order to limit the necessity for providing a large amount of a sterile cooling medium.

The cooling medium circulating inside coils 408 may generally be liquid and/or gaseous. The cooling medium circulating inside tubing 408 may comprise nitrogen, e.g., may comprise a nitrogen/air mixture, and/or brine/silicon oil, which is input into the coil system 408 via inflow 410. The present invention is not limited, however, to the exemplary cooling mediums mentioned above.

The droplet generation system 326 arranged with the dome 322 may for example comprise one or more high-frequency nozzles for transforming the flowable material (e.g., liquids and/or pastes) to be prilled into droplets. With regard to exemplary numerical values, the high frequency nozzles may have an operating range of between 1-4 kHz at a throughput of 5-30 g/min per nozzle with a liquid of solid content ranging from 5-50% (w/w).

The droplets 323 are frozen on their gravity-induced fall within the prilling tower 302 due to cooling mediated by the temperature-controlled wall 320 of the prilling tower 302 and an appropriate non-circulating atmosphere provided within the internal volume 328, for example, an (optionally sterile) nitrogen and/or air atmosphere. In one exemplary embodiment, in the absence of further cooling mechanisms, forming freezing droplets into round micropellets with sizes/diameters in the range of 100-800 μm an appropriate height of the prilling tower is between 1-2 m (meters) while forming freezing droplets into pellets with a size range up to 1500 μm (micrometers) the prilling tower is between about 2-3 m wherein the diameter of the prilling tower can be between about 50-150 cm for a height of 200-300 cm. The temperatures in the prilling tower can optionally be maintained or varied/cycled throughout between about −50° C. to −190° C.

The frozen droplets/micropellets 323 reach the bottom 324 of the prilling tower 302. In the embodiment discussed here, the product is then automatically transferred by gravity towards and into transfer section 308.

The transfer section 308 as illustrated in FIG. 3 comprises an inflow 332, an outflow 334, and an intermediary separation component 336. Each of inflow 332 and outflow 334, respectively, may comprise at least one double-walled tube, wherein the double wall may similarly be configured as described for the double walls 320 of the prilling tower 302 in FIG. 4. Specifically, the double walls of inflow 332 and/or outflow 334 may optionally comprise cooling circuitry for cooling an inner wall, sensor circuitry, and/or access points for cleaning/sterilization. For example, in preferred embodiments, a constant/increasing/decreasing temperature relative to the interior volume of the transfer section and the frozen/congealed product therein can be maintained throughout the transfer section 308.

As illustrated in FIG. 3, the inflow 332 and outflow 334 components are arranged to accomplish a transfer of the product from the prilling tower 302 to the freeze-dryer 304 by gravity (in other embodiments additionally, or alternatively, an active mechanical conveyance is provided comprising, e.g., a conveyor component, vibrating component, etc.). In order to maintain closed conditions such as sterility and/or containment for the transfer of the product between process devices, the transfer section 308 is optionally permanently connected to prilling tower 302 and the freeze-dryer 304, respectively, via schematically indicated fixing portions 338. The mechanical fixing portions 338 allow for the protection of sterility and/or containment at the transition from the respective process device to a transfer section and at the transition from a transfer section to the next process device. The skilled person is aware of design options available in this respect.

Permanent connections can be achieved with welding. In other embodiments, permanent connections, which are intended to be permanent during production runs, cleaning, sterilization, etc., but which can be disassembled for purposes of inspection, revision, validation, etc., can be achieved with screwing and/or bolting. Sealing technologies which may be applied in conjunction with the aforementioned techniques in order to provide the prerequisite for "closed conditions" (sterile and/or containment conditions) include, but are not limited to, flat seals or gaskets, or flange connections, and the like. Any sealing material should be absorption-resistant and should withstand low temperatures in order to avoid embrittling and/or attrition with risk of product pollution resulting there from. Also adhesive bonding may be employed as long as any adhesive is emission-free.

It is noted that a "sealing" property is understood as "leakage-free" for gas, liquids, and solids, to be maintained for pressure differences of, for example, atmospheric conditions on one side and vacuum conditions on the other side, wherein vacuum may mean a pressure as low as 10 millibar, or 1 millibar, or 500 microbar, or 1 microbar.

The separation component 336 is adapted for controllably providing an operative separation between prilling tower 302 and freeze-dryer 304. For example, the separation component 336 may comprise a closing device for closing up a transfer device such as a tube. Embodiments of closing devices include, but are not limited to, sealable separation means, such as a flap gate, lid, or valve. Non-limiting examples for suitable valve-types comprise butterfly valves, squeeze valves, and knife gate valves and the like.

Closed conditions can be preserved not only with respect to an environment of the process line 300, the requirement of "operative separation" can also include the requirement of a sterile/contained enclosure between the devices 302 and 304. For example, a vacuum-tight seal or lock can be provided in the separation component 336 in this respect. This may enable, for example, a freeze-drying batch mode production run in freeze-dryer 304 under vacuum, while a higher pressure, e.g., atmospheric pressure or hyperbaric pressure, is maintained in a separate component (e.g., the prilling tower 302) of the process line while it is engaged in another operational mode such as prilling, cleaning, or sterilization. Generally, separation means 336 can be adapted to separate various operational modes from each other, such that operative separation includes the sealable separation of operative conditions such as pressure (with vacuum or overpressure conditions on one side), temperature, humidity, etc.

FIG. 5 illustrates another exemplary embodiment of transfer section 500 which can be employed in place of the transfer section 308 (and/or transfer section 310) in process line 300 illustrated in FIG. 3. Similar to transfer sections 308 and 310, transfer section 500 comprises an inflow 502 and an outflow 504. However, instead of only one separating means such as a valve, transfer section 500 provides two such separating means 506 and 508. Further, transfer section 500 comprises a temporary storage component 510 interconnected between separating means 506 and 508. Embodiments are contemplated, in which the transfer section 500 of FIG. 5 replaces transfer section 308 in FIG. 3. Accordingly, the storage component 510 can optionally be adapted to store frozen pellets received from prilling tower 302, wherein the storage component 510 can receive and collect the product of a (semi)continuous production run from the prilling tower 302, or a fraction of a run there from, as controlled and/or metered by the opening and closing of separating means 506. Similarly, opening and closing separating means 508 controls the further flow of the product stored within the storage component 510 to freeze-dryer 304.

Provision of the two separating means, 506 and 508, with intermediary storage component 510 therefore provides further configuration options over that of mandatory direct transferring of the product from prilling tower 302 into freeze-dryer 304 as with the transfer section 308 in FIG. 3. Furthermore, the flexibility of this approach and the corresponding embodiments provides for further decoupling of the operation of prilling tower 302 and freeze-dryer 304, respectively, and consequently provides opportunities for advantageous independent operations of the respective process devices.

Generally, transfer section 500 is designed to preserve closed conditions (i.e., sterile conditions and/or containment) during transfer (and storage) of product between the process devices connected at inflow 502 and outflow 504, respectively. In this way, section 500 contributes to preserving process line end-to-end closed conditions. This particular feature of transfer section 500 is illustrated in FIG. 5 by the mechanical fixings 522 providing a means for permanently mechanically attaching transfer section 500 at the respective process device.

The transfer section 500, as illustrated in FIG. 5, comprises a double-walled inflow 502, outflow 504, and storage 510. While double walls 512 of inflow 502 and outflow 504 can be passively cooled, e.g., by isolation, double wall 514 of temporary storage 510 can be adapted to provide a temperature-controlled inner wall, i.e., active cooling of the inner wall. In this respect, reference numeral 516 indicates cooling circuitry provided within double walls 514 of storage component 510. Specifically, the double walls 514 of storage component 510 may be similarly configured as discussed above for double walls 320 of prilling tower 302 (cf. FIG. 4). In particular, besides cooling circuitry 516 for circulating a cooling medium, the double wall 514 (and/or double walls 512) can also enclose therein one or more additional tubing systems for transporting fluids and/or gases, such as cleaning mediums and/or sterilization mediums. In some preferred embodiments, these additional tubing systems are connected to access points 518 in transfer section 500. In still further embodiments, sensor circuitry for sensor elements 520 can also reside inside/traverse the double walls 512 and/or 514. Sensor elements 520 may comprise one or more temperature sensors, pressure sensors, and/or humidity sensors, etc.

While the exemplary transfer sections illustrated in FIGS. 3 and 5 contemplate product flow aided by gravity, other transfer mechanisms can optionally be employed, such as the combination of gravity and one or more other transfer mechanism. For example, other mechanisms for product conveyance include, but are not limited to, auger-based mechanisms, conveyer belts, pressure-driven mechanisms, gas-supported mechanisms, pneumatic-driven mechanisms, piston-based mechanisms, electrostatic mechanisms, and the like.

Referring back to FIG. 3, the product drying step can be performed by lyophilization, i.e., the sublimation of ice and removal of the resulting water vapour. The lyophilization process can be conducted in a vacuum rotary drum process device. In this regard, once the freeze-dryer is loaded with product, a vacuum is created in the freeze-drying chamber to initiate freeze-drying of the pellets. Low-pressure conditions referred to as "vacuum" herein may comprise pressures at or below 10 millibar, preferably at or below 1 millibar, particularly preferably at or below 500 microbar. In one example, the temperature range in the drying unit is held between about −20° C. to −55° C., or generally at or within a temperature range as required for adequate drying according to predefined specifications.

Accordingly, the freeze-dryer 304 is equipped with rotary drum 366 which due to its rotation provides for a large effective drying surface of the product and therefore fast drying compared to vial-based and/or tray-based drying. Embodiments of rotary drum drying devices, which may be suitable depending on the individual case, include, but are not limited to, vacuum drum dryers, contact-vacuum drum dryers, convective drum dryers, and the like. A specific rotary drum dryer is described, for example, in the DE 196 54 134 C2.

The term "effective product surface" is understood herein as referring to the product surface which is in fact exposed and therefore available for heat and mass transfer during the drying process, wherein the mass transfer may in particular include an evaporation of sublimation vapour. While the present invention is not limited to any particular mechanism of action or methodology, it is contemplated that rotation of the product during the drying process exposes more product surface area (i.e., increases the effective product surface) than conventional vial-based and/or tray-based drying methodologies (including, e.g., yl-brated tray-drying). Thus, utilization of one or more rotary-drum-based drying devices can lead to shorter drying cycle times than conventional vial-based and/or tray-based drying methodologies.

In preferred embodiments, besides process devices such as the prilling tower 302 and transfer sections such as the transfer section 308, the freeze-dryer 304 is also separately configured for operation under closed conditions. The freeze-dryer 304 is adapted for performing at least the operations of pellet freeze-drying, optionally automatic cleaning of the freeze-dryer in place, and automatic sterilization of the freeze-dryer in place.

Specifically, in certain embodiments, freeze-dryer 304 comprises a first chamber 362 and a second chamber 364, wherein first chamber 362 comprises a rotary drum 366 for receiving the product from prilling tower 302, and second chamber 364 comprises a condenser 368 and a vacuum pump for providing a vacuum in internal volume 370 of chamber 362 and internal volume 372 of drum 366. Valve 371 is provided for separating chambers 362 and 364 according to different operational modes of the freeze-dryer 304. Chamber 362 and/or 364 can be referred to as "vacuum chambers" as used herein by virtue of their operation.

In preferred embodiments, vacuum chamber 362 comprises a double walled structure having an outer wall 374 and an inner wall 376 being constructed similarly as illustrated in FIG. 4 for the double wall structure 320 of prilling tower 302. Specifically, double walls 374 and 376 optionally comprise cooling circuitry for cooling the inside 370 of vacuum chamber 362 and in particular the inner volume 372 of rotary drum 366 and additionally may further comprise one or more heating means such as heating pipes to be operable during the lyophilization process, cleaning process, and/or sterilization process. Additionally or alternatively, equipment for transferring heat to the particles during lyophilization such as, for example, heat conducting means, e.g., pipes for conveying a heating medium therethrough, means for ohmic heating, e.g., heating coils, and/or means for microwave heating, e.g., one or more magnetrons, can be provided elsewhere in association with drum 366 and/or chamber 362. Vacuum chamber 362 and outer wall 374 and inner wall 376 thereof may additionally comprise one or more sensor lines and/or pipes for conducting cleaning and/or sterilization media. Sensor elements related to sensing temperature, pressure, and the like, and installations 378 for automatic cleaning/sterilization in place can be arranged at the inner wall 376.

The drum 366 is supported in its rotational movement by supporting elements 380. Drum 366 has a free opening 382 so that pressure conditions (such as vacuum conditions), temperature conditions, etc., are promoted between internal volumes 370 and 372. In freeze-drying operation, for example, the vapour resulting from sublimation is drawn from volume 370 of drum 366 containing the pellets to be freeze-dried into volume 370 of the vacuum chamber 362 and further to chamber 364.

Outflow 334 of transfer section 308 comprises a protrusion 384 protruding into drum 366 of freeze-dryer 304 for guiding the product into the drum 366. As drum 366 is fully contained within vacuum chamber 362, it is not necessary to further isolate or separate the drum 366; in other words, the function of providing closed conditions for processing inside device 304 is with vacuum chamber 362. Therefore, in certain embodiments outflow 334 of transfer section 308 can be permanently connected to vacuum chamber 362 in this way. A complex mounting or docking/undocking arrangement between stationary transfer section 308 and rotating drum 366 is not required. According to the various embodiments of the present invention the sterile and/or contained transfer of product from prilling tower 302 into the rotary drum 366 of freeze-dryer 304 is reliably and cost-effectively implemented.

Further embodiments provide freeze-dryer 304 being specifically adapted for closed operation (i.e., for operation preserving sterility of the product to be freeze-dried and/or containment) wherein chambers 362 and 364 are designed for implementing an appropriately closed housing. Fixation means 386 can be provided at the freeze-dryer 304 for permanently connecting with the transfer section 308, in particular the fixation means 338 of transfer section 308, wherein the fixation means 338 and 386 are adapted to ensure, when affixed to each other, sterility and/or containment for the product transition from the transfer section 308 into freeze-dryer 304. Fixing means 338 and means 386 together may comprise welding, riveting, bolting, etc.

Transfer section 310 connects freeze-dryer 304 and discharge station 306. Unloading of drum 366 can be achieved, for example, by providing one or more of the following: 1) a discharge opening (either opening 382 and/or an opening in a cylindrical section of drum 366); 2) providing a discharge guiding means; and 3) inclining drum 366. The unloaded pellets can then flow with/out the assistance of gravity and/or one or more mechanical conveyances from chamber 362 via transfer section 310 into discharge station 306.

The discharge station 306 comprises one or more filling means 390 provided for dispensing the product received from the freeze-dryer 304 into recipients 392. Recipients 392 may comprise final recipients such as vials or intermediate recipients such as Intermediate Bulk Containers ("IBCs"). Similar to other process devices (e.g., devices 302 and 304), discharge station 306 is adapted for operation under closed conditions, such that, for example, a sterile product can be filled into a recipient 392 under sterile conditions. The discharge station 306 in the embodiment shown in FIG. 3 has double walls 394. Depending on the products intended to be processed using line 300, the double wall 394 may internally harbor installations such as those described in FIG. 4 with reference to the double wall 320 of the prilling tower 302. For example, the double wall 394 may not be equipped with cooling and/or heating circuitry, but may be equipped with sensor linings which connect to sensors arranged at the inner wall of discharge station 306 for sensing temperature, humidity, etc. Double wall 394 may further be equipped with piping for providing access points 396 with cleaning/sterilization medium. Besides loading recipients 392, the discharge station 306 can additionally be adapted for taking product samples and/or manipulating the product under closed conditions.

Freeze-dryer 304 and discharge station 306 are permanently connected via transfer section 310. Transfer section 310 comprises inflow 3102, outflow 3104 and separating means 3106. Transfer section 310 may be similar in design to transfer section 308. However, while transfer section 310 may be provided with double walls, cooling circuitry may be omitted either in outflow 3104 or in both inflow 3102 and outflow 3104, since in many cases dried product ready for discharge no longer requires cooling. Still then, double walls can be used to install/enclose sensor linings and pipelines for cleaning and/or sterilization (e.g., conducting cleaning and/or sterilization media), and/or can be used to reliably implement the closed conditions for protecting sterility of and/or providing containment for the product flow from the freeze-dryer 304 to the discharge station 306.

Figure 6:
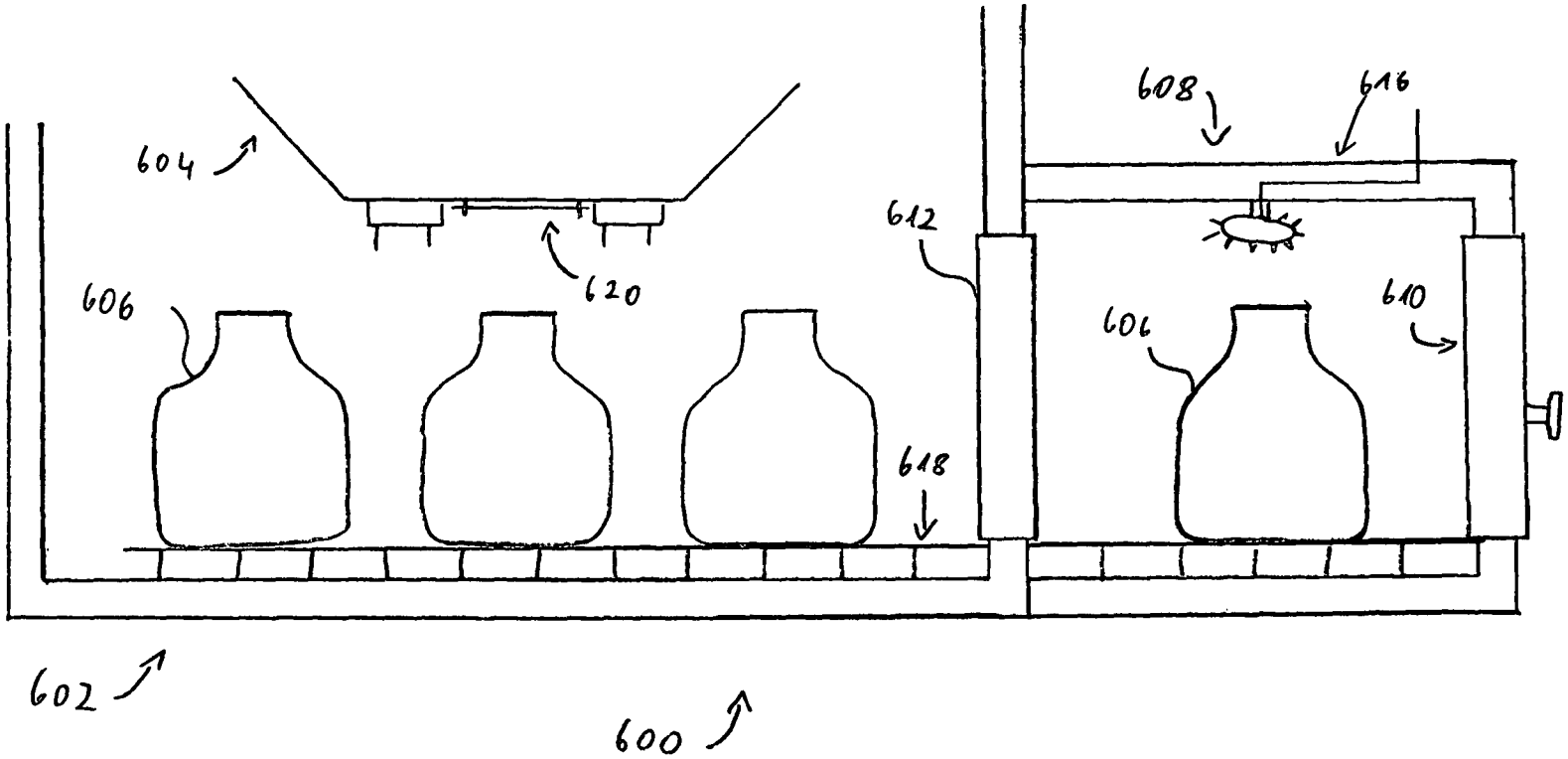
FIG. 6 an embodiment of a discharge station according to the invention.

FIG. 6 illustrates in pertinent part an alternative embodiment of a freeze-dryer 600 in accordance with the invention. The freeze-dryer 600 comprises a vacuum chamber 602 housing an internal rotary drum 604, the construction thereof may be similar to what has been described for the freeze-dryer 304 in FIG. 3. The freeze-dryer 600 is adapted for a direct discharge of the product, inside vacuum chamber 602, into recipients 606 under closed conditions, i.e., for example, under protection of the sterility of the product.

A sterilization chamber 608 can be loaded with one or more IBCs 606 via sealable gate 610. Chamber 608 has a further sealable gate 612 which when open allows transfer of IBCs between vacuum chamber 602 and sterilization chamber 608. After loading IBCs 606 from the environment via gate 610 into chamber 608, the IBCs 606 can be sterilized by means of sterilization equipment 616, which can, for example, be connected to a sterilization means also supplying sterilization media to SiP equipment of freeze-dryer 600. After sterilization of IBCs 606, gate 612 is opened and IBCs 606 are moved into the vacuum chamber 602 of freeze-dryer 600 by use of a mechanical conveyance (e.g., a traction system) 618.

Rotary drum 604 can optionally be equipped with a peripheral opening 620, as schematically indicated in FIG. 6, that can be automatically controlled to open after freeze-drying of a product batch has been completed for discharging the product from drum 604 into one or more of the IBCs 606. The traction system 618 may move filled IBCs 606 back into chamber 608 for appropriate sterile sealing of the IBCs 606, before unloading them from chamber 608. Appropriate sealing of filled IBCs 606 may alternatively also be performed in the vacuum chamber 602.

Transfer sections such as sections 308 and 310 described in process line 300 (FIG. 3) are provided for a bulk product flow between process devices under preservation of closed conditions. As there is no bulkware flow between vacuum chamber 602 and sterilization chamber 608, no further transfer section is needed in this embodiment. Nevertheless, sterilization chamber 608 is integrated with vacuum chamber 602 such that end-to-end closed conditions can be preserved in case empty recipients are to be introduced into the vacuum chamber 602. Preferably, gate 612 when closed preserves the sterility and/or containment of the product processed in freeze-dryer 600.

It is to be noted that the freeze-dryers illustrated in FIGS. 3 and 6 are not limited to vacuum freeze-drying techniques. Generally, freeze-drying including sublimation, can be performed with various pressure regimes and can be performed, for example, under atmospheric pressure. Therefore, a freeze-dryer employed in a process line according to the invention can be a vacuum freeze-dryer, a freeze-dryer adapted for freeze-drying at another pressure regime (which still would have to be adapted for closed operation, i.e., protect sterility and/or preserve containment), or a freeze-dryer which may be operated under varying pressure regimes, e.g., vacuum or atmospheric pressure.

Referring again to FIG. 3, as one aspect of providing a reliable and cost-effective permanently integrated process line that preserves end-to-end closed processing conditions, the entire process line 300 is adapted for CiP and/or SiP, such as indicated by exemplary cleaning/sterilization medium access points 330 in prilling tower 302, access points 340 in transfer section 308, access points 378 in freeze-dryer 304, and access points 396 in discharge station 306. Each of these access points can be provided with a sterilization medium such as steam via tubing 3302 in flow communication with preferably a single (and in other embodiments: several) sterilization medium repository 3304, optionally comprising, for example, a steam generator. The system of repository 3304 and tubing 3302 can be controlled accordingly such that cleaning and/or sterilization is performed for the entire line 300, or for one or more individual parts or subsections of the process line. Such situation is exemplarily illustrated in FIG. 2*b*, wherein only the prilling tower PT is cleaned and sterilized, while other devices such as FD and DS are in different operational modes (i.e., not engaged in CiP and/or SiP maintenance or otherwise). With regard to a transfer section adapted for operationally separating a first process device from a second process device, it is noted that optionally only a part of this transfer section can be subjected to cleaning/sterilization, namely in case the first (or second) process device is subjected to cleaning/sterilization: then (only) the inflow or outflow of the transfer section connected to the first (or second) process device can also be subjected to cleaning/sterilization.

Figure 7A:
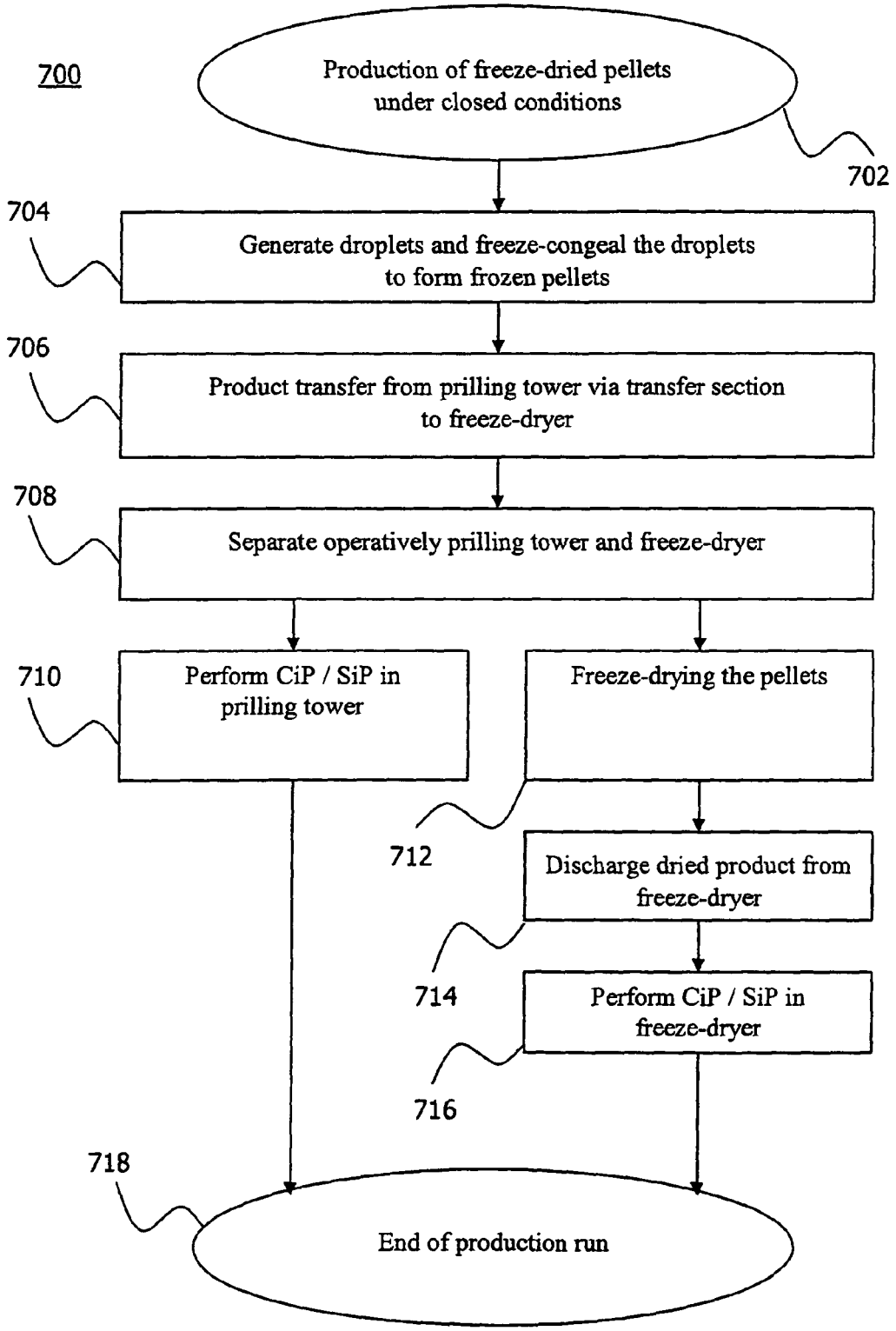
FIG. 7*a* a flow diagram illustrating a first embodiment of an operation of a process line according to the invention.

FIG. 7*a* illustrates an exemplary operative processing embodiment 700 of process line 300 of FIG. 3, as such reference will be taken to the process line and the processing devices thereof as necessary. Generally, the process is related to the production of freeze-dried pellets under closed conditions 702. In step 704, the prilling tower 302 is fed with flowable material (e.g., liquids and/or pastes) to be prilled and operates to generate droplets from the material and to freeze/congeal the liquid/liquefied droplets to form frozen bodies (e.g., product, particles, microparticles, pellets, micropellets). In step 706, which may be performed subsequently to step 704 as shown in FIG. 7*a*, but may also be performed at least in parallel to step 704, the product is transferred from the prilling tower 302 via transfer section 308 into the freeze-dryer 304 (eventually into the rotary drum 366 thereof) under closed conditions. For example, in case the production run 700 comprises the production of sterile micropellets, the transfer in step 706 occurs under protection of the sterility of the product.

When the prilling process in the prilling tower 302 is finalized and the frozen pellets generated therein have been transferred entirely into the freeze-dryer 304, as operatively illustrated in step 708 of FIG. 7*a*, the prilling tower 302 and freeze-dryer 304 are preferably operatively separated and independently controlled by valve 336 of transfer section 308 in order to sealably (e.g., under vacuum-tight conditions) separate devices 302 and 304 from each other. In certain embodiments, subsequent steps 710 and 712 can be performed at least partially in parallel. In step 712, the freeze-dryer 304 is operatively controlled to freeze-dry the pellets transferred previously in step 706 as bulkware. In step 710 CiP and/or SiP are performed in the prilling tower 302, for example to prepare the prilling tower for a subsequent production run.

In step 714 the freeze-dried product is discharged from the freeze-dryer 304 into the discharge station 306. Step 714 can be performed after step 712 is completed, but can also be performed in parallel to step 710. Discharging step 714 may comprise opening the transfer section 310. In order for a preservation of closed conditions, e.g., sterility, the discharge station 306 can be cleaned and/or sterilized prior to opening the transfer section 310.

After discharging is completed in step 714 and the entire batch production (or a portion thereof) is filled into one or more recipients 392, transfer section 310 can be configured to operatively separate the freeze-dryer 304 from the discharge station 306. In step 716, CiP and/or SiP can then be performed in the freeze-dryer 304. After de-loading filled recipients 392 from the discharge station 306, CiP/SiP can also be performed in the discharge station 306 either in parallel to steps 716 and/or 710 in freeze-dryer 304 or subsequently. As soon as steps 710 and 716 are finalized, the operation 700 of process line 300 has finalized and the process line 300 can be available for the next production run. Cleaning and/or sterilization steps 710 and 716 can be performed at any time, but are preferably performed prior to the beginning of a production run.

However, in other embodiments, subsequent production runs can commence without cleaning and/or sterilization of the freeze-dryer 304 being finalized (as in step 716 in FIG. 7), since in a process line which is operatively separable, subsequent production runs can begin as soon as cleaning and/or sterilization of the prilling tower has been completed.

Figure 7B:
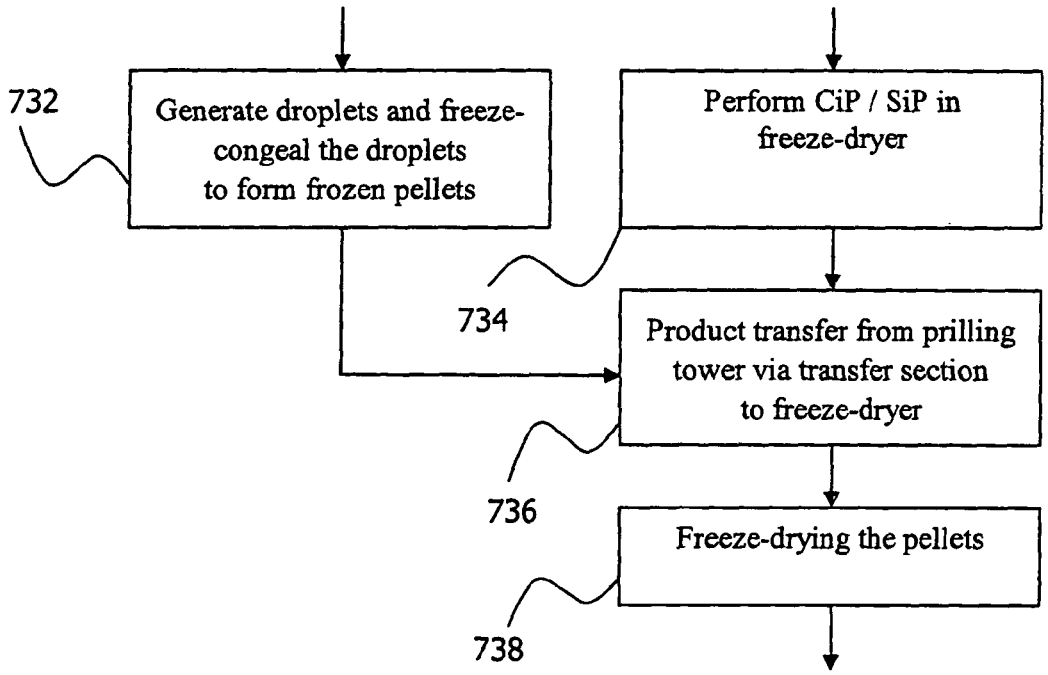
FIG. 7*b* a flow diagram illustrating a second embodiment of an operation of a process line according to the invention.

An exemplary operational scheme 730 is likewise illustrated in FIG. 7*b*. Step 732 comprises the feeding of liquid, generating of droplets therefrom and freeze-congealing of the liquid droplets to form frozen pellets in the prilling tower 302. Step 734 comprises the cleaning and/or sterilization of the freeze-dryer 304, i.e., is identical to step 716. In certain embodiments, steps 732 and 734 can be performed in parallel. Thus, step 732 can also be inserted into the scheme 700 of FIG. 7*a* to be performed after step 710 and in parallel to step 716.

After step 734 is finished, the transfer section 308 can be opened in step 736 allowing a product flow of the frozen pellets produced in step 732 and loading thereof into rotary drum 366. While step 736 has to follow step 734 in order for protection of sterility of the product, step 732 can be performed with any time relation to step 736, e.g., the prilling can start before or after opening the transfer section in step 736. Depending on process line configurations and parameters, it may be advantageous to fill the frozen pellets into a slowly rotating drum, as this is contemplated to help avoid particle (e.g., pellets or micropellets) agglomerations. Therefore, in certain embodiments, in step 706 and/or step 736 the rotary drum 366 is kept rotating. Further, the product transfer performed in step 706 and/or step 736 can be performed continuously during (i.e., in parallel to) the spray freezing in step 704 and/or step 732.

In a modified embodiment of process line 300, transfer section 500 of FIG. 5 is employed between prilling tower 302 and freeze-dryer 304 such that frozen pellets produced in prilling tower 302 can be stored temporarily in storage 512 of transfer section 500 until transfer valve 508 is opened in step 736 for loading the frozen pellets into the rotary drum 366. This sequence is contemplated to further decouple the operation of devices 302 and 304 from each other while maintaining closed conditions, i.e., sterility and/or containment. After loading of the pellets into the freeze-dryer 304, the pellets are freeze-dried in step 738. The process 730 in FIG. 7*b* can, for example, continue with steps (710 and) 714 and 716.

In another modified embodiment, the prilling tower continues prilling and feeding temporary storage 512 of transfer section 500 with frozen pellets, while the frozen pellets are batch-wise unloaded from the storage 512 into freeze-dryer 304 according to the capacity of freeze-dryer 304. Thus, production rates of prilling tower 302 and freeze-dryer 304, respectively, can be decoupled to some degree including (quasi)continuous and batchwise operational modes of the process devices can be coupled within the process line in cases of accordingly adapted and/or controllable transfer sections. Transfer sections do not may or may not be equipped with temporary storage as illustrated in FIG. 5. A transfer section such as section 308 in FIG. 3 may simply be controlled to "buffer" frozen pellets in the bottom area 324 of the prilling tower 302 by keeping separating means 336 closed.

The exemplary embodiments described herein are intended to illustrate the flexibility of process line concepts according to the invention. For instance, providing end-to-end closed conditions by process devices each specifically adapted for operation under closed conditions and permanently interconnecting these devices with transfer sections also adapted for protection of sterility and/or preservation of containment, avoids the necessity of employing one or more isolators for achieving closed conditions. A process line according to the invention can be operated in a non-sterile environment for manufacturing a sterile product. This leads to corresponding advantages in analytical requirements and associated costs. Further, preferred embodiments avoid the difficulties experienced in typical process lines employing multiple isolators that arise during product handling while bridging the interfaces between the various isolators. The process lines according to the invention are thus not limited by available isolator size, and in principle there are no size limits on process lines adapted for operation under closed conditions. The invention contemplates that considerable cost reductions are possible in typical fully conforming GMP, GLP (Good Laboratory Practice), and/or GCP (Good Clinical Practice), and international equivalents, manufacturing processes and operations, by avoiding the necessity of using a plurality of costly isolators.

In these or other embodiments, while the inventive process line concepts provide for an integrated system, for example, in the sense of end-to-end closed conditions, the process devices such as prilling tower (or other spray chamber device) and freeze-dryer are clearly kept separate from each other and are also operatively separable by function of the interconnected transfer sections. In this way, the disadvantages of highly integrated systems wherein the entire process is performed within a single specifically adapted device are avoided. Keeping multiple process devices as separate units allows one to separately optimize each of the process devices with regard to its specific functionality. For example, according to one embodiment of the invention, it is contemplated that a process line comprising a freeze-dryer comprising a rotary drum provides comparatively faster drying times than conventional methodologies. In further embodiments, separate optimization of process devices such as the prilling tower and/or the freeze-dryer allows for separate optimization of the cooling mechanisms applied. As illustrated in the examples, it is possible to provide process lines that do not need a sterile cooling medium such as liquid/gaseous nitrogen (mixtures), which correspondingly reduces production costs. As the inventive concepts are applicable to bulkware production, the process lines need not be adapted to any specific recipients such as IBCs or vials, and, in a further example, specific stoppers for drying in vials are not required. If desired, a process line can be adapted to specific recipients, but this may concern merely the device concerned with discharging, e.g., a discharge station of the line.

The products resulting from process lines adapted according to the invention can comprise virtually any formulation in liquid or flowable paste state that is suitable also for conventional (e.g., shelf-type) freeze-drying processes, for example, monoclonal antibodies, protein-based APIs, DNA-based APIs, cell/tissue substances, vaccines, APIs for oral solid dosage forms such as APIs with low solubility/bioavailability, fast dispersible oral solid dosage forms like ODTs, orally dispersible tablets, stick-filled adaptations, etc., as well as various products in the fine chemicals and food products industries. In general, suitable flowable materials for prilling include compositions that are amenable to the benefits of the freeze-drying process (e.g., increased stability once freeze-dried).

The invention allows the generation of, for example, sterile lyophilized and uniformly calibrated particles, e.g., micropellets, as bulkware. The resulting product can be free-flowing, dust-free and homogeneous. Such products have good handling properties and can be easily combined with other components, wherein the components might be incompatible in liquid state or only stable for a short time period and thus otherwise not suitable for conventional freeze-drying. Certain process lines can thus provide a basis for a separation of filling processes and prior drying processes, i.e., filling-on-demand becomes practically feasible. The relatively time-consuming manufacture of bulkware can readily be performed even if the dosing of the API is still to be defined. Different filling compositions/levels can easily be realized without the requirement for another liquid composition, spraying, drying and subsequent filling. The time-to-market can be reduced correspondingly.

Specifically, the stability of a variety of products can be optimized (e.g., including, but not limited to, single or multivariant vaccines with or without adjuvants). Conventionally, it has been known that freeze-drying is performed as a final step in the pharmaceutical industry which conventionally follows filling the product into vials, syringes, or larger containers. The dried product has to be rehydrated before its use. Freeze-drying in the form of particles, particularly in the form of micropellets allows similar stabilization of, for example, a dried vaccine product as known for mere freeze-drying alone, or it can improve stability for storage. The freeze-drying of bulkware (e.g., vaccine or fine chemical micropellets) offers several advantages in comparison to conventional freeze-drying; for example, but not limited to, the following: it allows the blending of the dried products before filling, it allows titers to be adjusted before filling, it allows minimizing the interaction(s) between any products, such that the only product interaction occurs after rehydration, and it allows in many cases an improvement in stability.

In fact, the product to be bulk freeze-dried, can result from a liquid containing, for example, antigens together with an adjuvant, the separate drying of the antigens and the adjuvant (in separate production runs, which can, however, be performed on the same process line according to the invention), followed by blending of the two ingredients before the filling or by a sequential filling. In other words, the stability can be improved by generating separate micropellets of antigens and adjuvant, for example. The stabilizing formulation can be optimized independently for each antigen and the adjuvant. The micropellets of antigens and adjuvant can subsequently be filled into the final recipients or can be blended before filling into the recipients. The separated solid state allows one to avoid throughout storage (even at higher temperature) interactions between antigens and adjuvant. Thus, configurations might be reached, wherein the content of the vial can be more stable than any other configurations. Interactions between components can be standardized as they occur only after rehydration of the dry combination with one or more rehydrating agents such as a suitable diluent (e.g., water or buffered saline).

In order to support a permanently mechanically integrated system providing end-to-end sterility and/or containment, additionally, a specific cleaning concept for the entire process line is contemplated. In a preferred embodiment, a single steam generator, or similar generator/repository for a cleaning/sterilization medium is provided which via appropriate pipings serves the various process devices including the transfer sections of the line. The cleaning/sterilization system can be configured to perform automatic CiP/SiP for parts of the line or the entire line, which avoids the necessity of complex and time-consuming cleaning/sterilization processes which require disassembly of the process line and/or which have to be performed at least in part manually. In certain embodiments, cleaning/sterilization of isolators is not required or avoided completely. Cleaning/sterilization of only a part of the process line can be performed, while other parts of the line are in different operational modes, including, running at full processing capability. Conventional, highly integrated systems normally offer only the possibility to clean and/or sterilize the entire system at once.

Accordingly, the subject matter of the invention is relating to a process for preparing a vaccine composition comprising one or more antigens in the form of freeze-dried particles comprising:

Freeze-drying a liquid bulk solution comprising one or more antigens according to the process of the invention, and Filling the freeze-dried particles obtained into a recipient.

In a further aspect the invention is relating to a process for preparing an adjuvant containing vaccine composition comprising one or more antigens in the form of freeze-dried particles comprising:

Freeze-drying a liquid bulk solution comprising an adjuvant and one or more antigens according to the process according to the invention, and Filling the freeze-dried particles obtained into a recipient.

Alternatively when the one or more antigens and the adjuvant are not in the same solution, the process for preparing an adjuvant containing vaccine composition comprises:

Freeze-drying separately a liquid bulk of adjuvant and a liquid bulk solution comprising one or more antigens according to the process of the invention, Blending the freeze dried particles of said one ore more antigens with the freeze dried particles of said adjuvant, and Filling the blending of freeze-dried particles into a recipient.

The liquid bulk solution of antigen(s) may contain for instance killed, live attenuated viruses or antigenic component of viruses like Influenza virus, Rotavirus, Flavivirus (including for instance dengue (DEN) viruses serotypes 1, 2, 3 and 4, Japanese encephalitis (JE) virus, yellow fever (YF) virus and West Nile (WN) virus as well as chimeric flavivirus), Hepatitis A and B virus, Rabies virus. The liquid bulk solutions of antigen(s) may also contain killed, live attenuated bacteria, or antigenic component of bacteria such as bacterial protein or polysaccharide antigens (conjugated or non-conjugated), for instance from sero-type b *Haemophilus influenzae, Neisseria meningitidis, Clostridium tetani, Corynebacterium diphtheriae, Bordetella pertussis, Clostridium botulinum, Clostridium difficile.*

A liquid bulk solution comprising one or more antigens means a composition obtained at the end of the antigen production process. The liquid bulk solution of antigen(s) can be a purified or a non purified antigen solution depending on whether the antigen production process comprises a purification step or not. When the liquid bulk solution comprises several antigens, they can originate from the same or from different species of microorganisms. Usually, the liquid bulk solution of antigen(s) comprises a buffer and/or a stabilizer that can be for instance a monosaccharide such as mannose, an oligosaccharide such as sucrose, lactose, trehalose, maltose, a sugar alcohol such as sorbitol, mannitol or inositol, or a mixture of two or more different of these aforementioned stabilizers such as a mixture of sucrose and trehalose. Advantageously, the concentration of monosaccharide oligosaccharide, sugar alcohol or mixture thereof in the liquid bulk solution of antigen(s) ranges from 2% (w/v) to the limit of solubility in the formulated liquid product, more particularly it ranges from 5% (w/v) to 40% (w/v), 5% (w/v) to 20% (w/v) or 20% (w/v) to 40% (w/v).

Compositions of liquid bulk solutions of antigen(s) containing such stabilizers are described in particular in WO 2009/109550, the subject matter of which is incorporated by reference.

When the vaccine composition contains an adjuvant it can be for instance:

1) a particulate adjuvant such as: liposomes and in particular cationic liposomes (e.g. DC-Chol, see e.g. US 2006/0165717, DOTAP, DDAB and 1,2-Dialkanoyl-sn-glycero-3-ethylphosphocholin (EthylPC) liposomes, see U.S. Pat. No. 7,344,720), lipid or detergent micelles or other lipid particles (e.g. Iscomatrix from CSL or from Isconova, virosomes and proteocochleates), polymer nanoparticles or microparticles (e.g. PLGA and PLA nano- or microparticles, PCPP particles, Alginate/chitosan particles) or soluble polymers (e.g. PCPP, chitosan), protein particles such as the *Neisseria meningitidis* proteosomes, mineral gels (standard aluminum adjuvants: AlOOH, $AlPO_4$), microparticles or nanoparticles (e.g. $Ca_3(PO_4)_2$), polymer/aluminum nanohybrids (e.g. PMAA-PEG/AlOOH and PMAAPEG/$AlPO_4$ nanoparticles) O/W emulsions (e.g. MF59 from Novartis, AS03 from GlaxoSmithKline Biologicals) and W/O emulsion (e.g. ISA51 and ISA720 from Seppic, or as disclosed in WO 2008/009309). For example, a suitable adjuvant emulsion for the process according to the present invention is that disclosed in WO 2007/006939.
2) a natural extracts such as: the saponin extract QS21 and its semi-synthetic derivatives such as those developed by Avantogen, bacterial cell wall extracts (e.g. micobacterium cell wall skeleton developed by Corixa/GSK and micobaterium cord factor and its synthetic derivative, trehalose dimycholate).
3) a stimulator of Toll Like Receptors (TLR). It is particular natural or synthetic TLR agonists (e.g. synthetic lipopeptides that stimulate TLR2/1 or TLR2/6 heterodimers, double stranded RNA that stimulates TLR3, LPS and its derivative MPL that stimulate TLR4, E6020 and RC-529 that stimulate TLR4, flagellin that stimulates TLR5, single stranded RNA and 3M's synthetic imidazoquinolines that stimulate TLR7 and/or TLR8, CpG DNA that stimulates TLR9, natural or synthetic NOD agonists (e.g. Muramyl dipeptides), natural or synthetic RIG agonists (e.g. viral nucleic acids and in particular 3' phosphate RNA).

When there is no incompatibility between the adjuvant and the liquid bulk solution of antigen(s) it can be added directly to the solution. The liquid bulk solution of antigen(s) and adjuvant may be for instance a liquid bulk solution of an anatoxin adsorbed on an aluminium salt (alun, aluminium phosphate, aluminium hydroxide) containing a stabilizer such as mannose, an oligosaccharide such as sucrose, lactose, trehalose, maltose, a sugar alcohol such as sorbitol, mannitol or inositol, or a mixture thereof. Examples of such compositions are described in particular in WO 2009/109550, the subject matter of which is incorporated by reference.

The freeze-dried particles of the non adjuvanted or adjuvanted vaccine composition are usually under the form of spheric particles having a mean diameter between 200 μm and 1500 μm. Furthermore since the process line according to the invention has been designed for the production of particles under "closed conditions" and can be sterilized, advantageously, the freeze-dried particles of the vaccine compositions obtained are sterile.

While the current invention has been described in relation to its preferred embodiments, it is to be understood that this description is for illustrative purposes only.

This application claims priority of European patent application EP 11 008 057.9-1266, the subject-matters of the claims of which are listed below for the sake of completeness:

1. A process line for the production of freeze-dried particles under closed conditions, the process line comprising at least the following separate devices:

a spray chamber for droplet generation and freeze congealing of the liquid droplets to form particles; and a bulk freeze-dryer (304) for freeze drying the particles; wherein a transfer section is provided for a product transfer from the spray chamber to the freeze-dryer, and for the production of the particles under end-to-end closed conditions each of the devices and of the transfer section is separately adapted for closed operation.

2. The process line according to item 1, wherein the transfer section permanently interconnects the two devices to form an integrated process line for the production of the particles under end-to-end closed conditions.

3. The process line according to item 2, wherein the transfer section comprises means for operatively separating the two connected devices from each other such that at least one of the two devices is operable under closed conditions separately from the other device without affecting the integrity of the process line.

4. The process line according to any one of the preceding items, at least one of the process devices and the transfer section comprises a confining wall which is adapted for providing predetermined process conditions within a confined process volume, wherein the confining wall is adapted for isolating the process volume and an environment of the process device from each other.

5. The process line according to any one of the preceding items, wherein the process devices and the transfer section form an integrated process line providing end-to-end protection of sterility of the product and/or end-to-end containment of the product.

6. The process line according to any one of the preceding items, wherein the freeze-dryer is adapted for separated operation under closed conditions, the separated operation including at least one of particle freeze-drying, cleaning of the freeze-dryer, and sterilization of the freeze-dryer.

7. The process line according to any one of the preceding items, wherein the integrated process line comprises as further device a product handling device adapted for at least one of discharging the product from the process line, taking product samples, and manipulating the product under closed conditions.

8. The process line according to any one of the preceding items, wherein the spray chamber (comprises at least one temperature-controlled wall for freeze congealing the liquid droplets.

9. The process line according to any one of the preceding items, wherein the freeze-dryer is a vacuum freeze-dryer.

10. The process line according to any one of the preceding items, wherein the freeze-dryer comprises a rotary drum for receiving the particles.

11. The process line according to any one of the preceding items, wherein at least one of the one or more transfer sections of the process line comprises at least one temperature-controlled wall.

12. The process line according to any one of the preceding items, wherein the entire process line is adapted for Cleaning in Place "CiP" and/or Sterilization in Place "SiP".

13. A process for the production of freeze-dried particles under closed conditions performed by a process line according to any one of the preceding items, the process comprising at least the following process steps:

generating liquid droplets and freeze congealing of the liquid droplets to form particles in a spray chamber;

transferring the product under closed conditions from the spray chamber to a freeze-dryer via a transfer section; and freeze drying the particles as bulkware in the freeze-dryer;

wherein for the production of the particles under end-to-end closed conditions each of the devices and of the transfer section is separately operated under closed conditions.

14. The process according to item 13, wherein the product transfer to the freeze-dryer is performed in parallel to droplet generation and freeze-congealing in the spray chamber.

15. The process according to any one of items 13 and 14, comprising a step of operatively separating spray chamber and freeze-dryer to perform CiP and/or SiP in one of the separated devices.

The invention claimed is:

1. A process line for the production of freeze-dried particles under closed conditions, the process line comprising at least the following process devices:

a spray chamber for generation of discrete liquid droplets and freeze congealing of the liquid droplets to form particles; and a bulk freeze-dryer for freeze drying the particles, the freeze-dryer comprising a rotary drum for receiving the particles; wherein a transfer section is provided for a particle transfer from the spray chamber to the freeze-dryer, wherein the transfer section permanently interconnects the process devices to form an integrated process line for the production of the particles under end-to-end closed conditions, for the production of the particles under end-to-end closed conditions each of the process devices and of the transfer section is separately adapted for operation preserving sterility of the particles to be freeze-dried and/or containment in order to provide a flexibly adaptable process line for enabling independent control of an operational mode of each process device, wherein the process line is cleanable in place ("CiP") and/or sterilizable in place ("SiP"), and the spray chamber comprises a double wall defining an internal volume therein, which double wall houses sterilization piping providing sterilization medium supply for sterilization of the spray chamber.

2. The process line according to claim 1, at least one of the process devices and the transfer section comprises a confining wall which is adapted for providing predetermined process conditions within a confined process volume, wherein the confining wall is adapted for isolating the process volume and an environment of the process devices from each other.

3. The process line according to claim 1, wherein the process devices and the transfer section form an integrated process line providing end-to-end protection of sterility of the particles and/or end-to-end containment of the particles.

4. The process line according to claim 1, wherein the freeze-dryer is adapted for separated operation under closed conditions, the separated operation including at least one of particle freeze-drying, cleaning of the freeze-dryer, and sterilization of the freeze-dryer.

5. The process line according to claim 1, wherein the integrated process line comprises as further device a product handling device adapted for at least one of discharging the particles from the process line, taking particle samples, and manipulating the particles under closed conditions.

6. The process line according to claim 1, wherein the spray chamber comprises at least one temperature-controlled wall for freeze congealing the liquid droplets.

7. The process line according to claim 1, wherein the freeze-dryer is a vacuum freeze-dryer.

8. The process line according to claim 1, wherein the transfer section of the process line comprises at least one temperature-controlled wall.

9. The process line according to claim 8, wherein the at least one temperature-controlled wall is an actively cooled inner wall of the transfer section.

10. The process line according to claim 1, wherein the transfer section comprises means for operatively separating the process devices from each other such that at least one of the process devices is operable under closed conditions separately from the other process device without affecting the integrity of the process line, wherein the means for operatively separating the process devices from each other comprises a valve, a vacuum lock, and/or a component which enables sealably separating the components from each other.

11. The process line according to claim 10, wherein the valve is a vacuum-tight valve.

12. The process line according to claim 1, wherein the particles have a tendency to be generally spherical.

13. The process line of claim 1, wherein the function of cleanability in place ("CiP") and/or sterilizability in place ("SiP") is achieved automatically in place throughout the process line or in one or more of parts thereof.

14. The process line of claim 13, wherein the function of cleanability in place ("CiP") and/or sterilizability in place ("SiP") is achieved by a CiP/SiP system.

15. The process line of claim 14, wherein the CiP/SiP system comprises access points for introduction of a cleaning medium and/or a sterilization medium throughout the process line or in one or more of parts thereof.

16. The process line of claim 15, wherein the access points comprise nozzles or steam access points.

17. The process line of claim 16, wherein all or some of the access points are connected to a cleaning and/or sterilization medium repository/generator.

18. The process line of claim 1, wherein steam as a sterilization medium is supplied via the sterilization piping, which enters the spray chamber via one or more sterilization heads at access points on the inside wall of the vacuum chamber.

19. A process for the production of freeze-dried particles under dosed conditions performed by a process line according to claim 1, the process comprising at least the following process steps:

generating liquid droplets and freeze congealing of the liquid droplets to form particles in a spray chamber;

transferring the particles under closed conditions from the spray chamber to a freeze-dryer via a transfer section; and freeze drying the particles as bulkware in the freeze-dryer, the freeze-dryer comprising a rotary drum for receiving the particles;

wherein for the production of the particles under end-to-end closed conditions each of the process devices and of the transfer section is separately adapted for operation preserving sterility of the particles to be freeze-dried and/or containment in order to provide a flexibly adaptable process line for enabling independent control of an operational mode of each process device.

20. The process according to claim 19, wherein the particle transfer to the freeze-dryer is performed in parallel to droplet generation and freeze-congealing in the spray chamber.

21. The process according to claim 19, comprising a step of operatively separating spray chamber and freeze-dryer to perform Cleaning in Place ("CiP") and/or Sterilization in Place ("SiP") in one of the process devices.

22. A process for preparing a vaccine composition comprising one or more antigens in the form of freeze-dried particles comprising:

freeze-drying a liquid bulk solution comprising said one or more antigens according to the process as described in claim 19; and filling the freeze-dried particles obtained into a recipient.

23. A process according to claim 22, wherein all the steps of the process are carried out under sterile conditions.

24. A process according to claim 22, wherein the freeze-dried particles are sterile.

25. A process for preparing an adjuvant containing vaccine composition comprising one or more antigens in the form of freeze-dried particles comprising:

a. freeze-drying a liquid bulk solution comprising said adjuvant and said one or more antigens according to the process as described in claim 19, and b. filling the freeze-dried particles obtained into a recipient; or alternatively when the liquid bulk solution of a) does not comprise said adjuvant, c. freeze-drying separately a liquid bulk of said adjuvant and a liquid bulk solution comprising said one or more antigens according to the process as described in claim 19, d. blending the freeze dried particles of said one or more tiger's with the freeze dried particles of adjuvant, and e. filling the blending of freeze-dried particles into a recipient.

26. A process according to claim 25, wherein all the steps of the process are carried out under sterile conditions.

27. A process according to claim 25, wherein the freeze-dried particles are sterile.

* * * * *